US010203153B2

(12) United States Patent
Adachi et al.

(10) Patent No.: US 10,203,153 B2
(45) Date of Patent: Feb. 12, 2019

(54) REFRIGERATOR

(71) Applicant: SAMSUNG ELECTRONICS CO., LTD., Suwon-si, Gyeonggi-do (KR)

(72) Inventors: Go Adachi, Yokohama (JP); Daisuke Uchida, Yokohama (JP); Junji Yoshida, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 33 days.

(21) Appl. No.: 15/539,904

(22) PCT Filed: Dec. 28, 2015

(86) PCT No.: PCT/KR2015/014362
§ 371 (c)(1),
(2) Date: Jun. 26, 2017

(87) PCT Pub. No.: WO2016/105177
PCT Pub. Date: Jun. 30, 2016

(65) Prior Publication Data

US 2018/0017317 A1 Jan. 18, 2018

(30) Foreign Application Priority Data

Dec. 26, 2014 (JP) ..... 2014-266761
Feb. 18, 2015 (JP) ..... 2015-029929
(Continued)

(51) Int. Cl.
*F25D 27/00* (2006.01)
*F21K 9/64* (2016.01)
(Continued)

(52) U.S. Cl.
CPC ..... *F25D 27/00* (2013.01); *F21K 9/64* (2016.08); *F21V 5/04* (2013.01); *F21V 7/04* (2013.01);
(Continued)

(58) Field of Classification Search
CPC ... F25D 27/00; F21K 9/64; F21V 5/04; F21V 7/04; F21V 13/14; F21V 33/0044
(Continued)

(56) References Cited

U.S. PATENT DOCUMENTS 5,559,681 A * 9/1996 Duarte ..... F21V 21/08 362/231
6,558,017 B1 * 5/2003 Saraiji ..... A47F 3/001 108/23
(Continued)

FOREIGN PATENT DOCUMENTS

JP 2011-12917 1/2011
KR 10-2007-0052144 5/2007
(Continued)

OTHER PUBLICATIONS

International Written Opinion of the International Searching Authority, PCT/ISA/237, dated Jun. 29, 2016, in corresponding International Patent Application No. PCT/KR2015/014362.
(Continued)

*Primary Examiner* — Bryon T Gyllstrom
(74) *Attorney, Agent, or Firm* — Staas & Halsey LLP

(57) ABSTRACT

Disclosed is a refrigerator including an illumination unit that prevents glare and provides sufficient light inside the storage chamber. The refrigerator includes a storage chamber having an opening formed at a front thereof and an illumination unit mounted in the storage chamber. The illumination unit includes a light emitting member to emit light and an optical member to guide light emitted from the light emitting
(Continued)

member to travel within a predetermined range of angles. Light emitted from the light emitting member is prevented from proceeding forward by the reflecting member and proceeds to the rear of the storage chamber.

19 Claims, 22 Drawing Sheets

(30) Foreign Application Priority Data

| | | |
|---|---|---|
| Sep. 9, 2015 | (JP) | 2015-177817 |
| Dec. 3, 2015 | (JP) | 2015-236937 |
| Dec. 4, 2015 | (JP) | 2015-237600 |
| Dec. 28, 2015 | (KR) | 10-2015-0187861 |

(51) Int. Cl.

| | |
|---|---|
| ***F21V 5/04*** | (2006.01) |
| ***F21V 7/04*** | (2006.01) |
| ***F21V 13/14*** | (2006.01) |
| ***F21V 33/00*** | (2006.01) |
| *F21Y 115/10* | (2016.01) |

(52) U.S. Cl.
CPC ..... *F21V 13/14* (2013.01); *F21V 33/0044* (2013.01); *F21Y 2115/10* (2016.08); *F25D 2500/02* (2013.01)

(58) Field of Classification Search
USPC ..... 362/604
See application file for complete search history.

(56) References Cited

U.S. PATENT DOCUMENTS

| | | | | |
|---|---|---|---|---|
| 7,559,672 | B1 * | 7/2009 | Parkyn | A47B 97/00 362/127 |
| 7,573,189 | B2 * | 8/2009 | Juestel | C09K 11/7774 257/81 |
| 7,828,467 | B2 * | 11/2010 | Lee | F21S 8/08 362/237 |
| 8,220,962 | B2 * | 7/2012 | Cheng | F21V 7/0083 362/227 |
| 2003/0137828 | A1 * | 7/2003 | Ter-Hovhannisian | A47F 3/001 362/92 |
| 2007/0247831 | A1 * | 10/2007 | Buelow, II | A47F 3/001 362/92 |
| 2008/0007945 | A1 * | 1/2008 | Kelly | A47F 3/001 362/218 |
| 2009/0244884 | A1 * | 10/2009 | Trulaske, Sr. | A47F 3/001 362/94 |
| 2010/0097780 | A1 * | 4/2010 | Beatenbough | A47F 3/001 362/92 |
| 2010/0220460 | A1 | 9/2010 | Hall | |
| 2011/0320024 | A1 * | 12/2011 | Lin | F21V 5/04 700/98 |
| 2012/0002414 | A1 * | 1/2012 | Gould | F21S 2/005 362/235 |
| 2012/0268950 | A1 * | 10/2012 | Parkyn | F21V 5/04 362/335 |
| 2017/0186926 | A1 * | 6/2017 | Kang | H01L 33/60 |

FOREIGN PATENT DOCUMENTS

| | | |
|---|---|---|
| KR | 10-2007-0092677 | 9/2007 |
| KR | 10-2010-0086850 | 8/2010 |

OTHER PUBLICATIONS

International Search Report dated Jun. 29, 2016, in corresponding International Patent Application No. PCT/KR2015/014362.

* cited by examiner

REFRIGERATOR

CROSS-REFERENCE TO RELATED APPLICATION

This application is a U.S. National Stage Application which claims the benefit under 35 U.S.C. § 371 of PCT International Patent Application No. PCT/KR2015/014362, filed Dec. 28, 2015, which claims the foreign priority benefit under 35 U.S.C. § 119 of Japanese Patent Application No. 2014-266761 filed Dec. 26, 2014, Japanese Patent Application No. 2015-029929 filed Feb. 18, 2015, Japanese Patent Application No. 2015-177817 filed Sep. 9, 2015, Japanese Patent Application No. 2015-236937 filed Dec. 3, 2015, Japanese Patent Application No. 2015-237600 filed Dec. 4, 2015, and Korean Patent Application No. 10-2015-0187861, filed Dec. 28, 2015, the contents of which are incorporated herein by reference.

TECHNICAL FIELD

Embodiments disclosed herein relate to a refrigerator having an improved illumination unit.

BACKGROUND ART

Japanese Patent Publication No. 2012-26678 discloses a refrigerator having a refrigerating chamber in which a loading shelf to load food is mounted, and a plurality of light emitting diodes disposed on the ceiling side in the refrigerating chamber to emit light. The plurality of light emitting diodes are arranged so that optical axes of the light emitting diodes are directed toward the front side of the refrigerating chamber while crossing the uppermost loading shelf.

The refrigerator is provided with an illumination unit for illuminating the inside of a storage compartment. Conventionally, even if an illumination unit is provided inside the refrigerator, the inside of the storage compartment may be felt dark. Also, when the luminance of the illumination unit provided inside the storage compartment is increased, there is a possibility that a user may feel dazzled. In such cases, the user may find it difficult to see food or the like inside the storage compartment.

DISCLOSURE

Technical Problem

It is an aspect of the present disclosure to provide a refrigerator including an illumination unit that improves brightness perception in the storage compartment and enables stored articles in the storage compartment to be easily seen.

Technical Solution

In accordance with an aspect of the present disclosure, a refrigerator includes a storage chamber having an opening formed at a front thereof; and an illumination unit mounted in the storage chamber. The illumination unit includes: a light emitting member configured to emit light; and an optical member configured to guide light emitted from the light emitting member for the light to travel within a predetermined range of angles. Light emitted from the light emitting member is prevented from proceeding forward by the optical member and proceeds rearward of the storage chamber.

Light emitted from the light emitting member may be reflected by the optical member and has an angle of 20 degrees to 60 degrees with respect to a vertical axis extending vertically from one surface of the storage chamber.

The optical member may include a lens member positioned in front of the light emitting member and configured to refract light emitted from the light emitting member.

The illumination unit may include a cover member through which light emitted from the light emitting member passes.

The cover member may include a first cover portion extending in one direction and a second cover portion having a degree of light diffusion higher than a degree of light diffusion of the first cover portion and provided in parallel with the first cover portion.

The first cover portion and the second cover portion are integrally formed with each other.

The first cover portion and the second cover portion may be provided to be in a range of 20 degrees or more and 60 degrees or less with respect to a vertical axis extending vertically from one surface of the storage chamber, and may be configured to guide light emitted from the light emitting member to an inside of the storage chamber.

The optical member may comprise a reflecting member, and light emitted from the light emitting member is reflected by the reflecting member and is incident on the cover member.

The optical member may include a first reflecting member positioned in front of the light emitting member and reflecting light that is directed to an inside of the storage chamber, and a second reflecting member reflecting the light reflected from the first reflecting member toward a rear of the inside of the storage chamber.

The illumination unit may include a plurality of light-emitting members and the one lens member may be positioned in front of the plurality of light-emitting members.

A plurality of the lens members may be provided so as to correspond to the plurality of light emitting members.

The optical member may include a wavelength converting member to convert a wavelength of light emitted from the light emitting member.

The wavelength converting member may include a fluorescent substance that absorbs light emitted from the light emitting member and emits light of a long wavelength.

The wavelength converting member may include a green fluorescent portion that absorbs blue light and emits green light, and a red fluorescent portion that absorbs blue light and emits red light.

The illumination unit may comprise a cover member through which light emitted from the light emitting member passes, and a reflecting member to reflect the light which is wavelength-converted by the wavelength converting member so as to be incident on the cover member.

In accordance with another aspect of the present disclosure, a refrigerator includes a storage chamber in which articles are stored and an illumination unit mounted in the storage chamber. The illumination unit includes a light emitting member configured to emit light and a cover member including a first diffusion portion configured to guide light emitted from the light emitting member to an inside of the storage chamber and diffuse light emitted from the light emitting member, and a second diffusion portion having a degree of light diffusion larger than a degree of light diffusion of the first diffusion portion.

The first diffusion portion may be inclined at a predetermined angle with respect to a vertical axis extending vertically from one surface of the storage chamber in which the illumination unit is installed, and the second diffusion portion extends parallel to the first diffusion portion.

A plurality of the first diffusion portions and a plurality of the second diffusion portions may be alternately positioned.

The refrigerator may comprises a reflecting member configured to reflect light emitted from the light emitting member so as to be incident on the cover member, and an optical member configured to guide light emitted from the light emitting member so as to be incident on the reflecting member.

In one surface of the reflecting member, an angle formed between an optical axis of a reflecting surface distant from the light emitting member and a vertical axis extending vertically from one surface of the storage chamber may be smaller than an angle formed between an optical axis of a reflecting surface adjacent to the light emitting member and the vertical axis.

In accordance with still another aspect of the present disclosure, a refrigerator includes a storage chamber in which articles are stored and an illumination unit mounted in the storage chamber. The illumination unit includes a light emitting element that emits light and an optical member to guide the light emitted from the light emitting element to an inside of the storage chamber and preventing the light emitted from the light emitting element from traveling toward a front of the storage chamber.

The optical member may control light distribution so that an angle formed by a maximum luminance of light emitted from the light emitting element and a vertical axis extending perpendicularly from one surface of the storage chamber is in a range of 20° to 60°.

The optical member forms a light distribution pattern having a shape symmetrical with respect to a light beam having the maximum luminance.

The optical member may control the light distribution so that a distribution angle is a narrow angle.

The optical member may control the light distribution so that an illuminance of the rear surface portion of the storage chamber is uniform in the left and right direction.

In accordance with still another aspect of the present disclosure, a refrigerator includes a storage chamber having an opening formed at a front thereof, a light emitting element and an illumination unit having an optical member to allow the light emitted from the light emitting element to travel to an inside of the storage chamber and to prevent the light emitted from the light emitting element from traveling toward the opening. At least one illumination unit is provided on a side surface portion of the storage chamber.

The optical member may control so that an angle formed by a maximum luminance of light emitted from the light emitting element and a vertical axis extending perpendicularly from one side surface of the storage chamber is in a range of 30° to 60°.

A substrate of the light emitting element may be mounted on the side surface of the storage chamber.

The optical member may controls light distribution so that an illuminance between both opposite side surfaces is uniform.

In accordance with one aspect of the present disclosure, an illumination apparatus includes a light emitting element that emits light from one direction to another direction and an optical member to guide the light emitted from the light emitting element to proceed in one direction and to prevent the light emitted from the light emitting element to proceed in another direction. The optical member includes a first diffusion portion to diffuse light of the light emitting element and a second diffusion portion having a degree of light diffusion larger than that of the first diffusion portion. The second diffusion portion is provided to be inclined to have a predetermined angle with a vertical axis extending perpendicularly to the optical member so that light passing through the second diffusion unit proceeds in one direction and the second diffusion portion is provided to extend along one direction in parallel with the first diffusion portion.

The illumination apparatus may include a reflecting member to reflect the light emitted from the light emitting element in one direction and a control member to control the light emitted from the light emitting element and traveling toward another direction to be incident on the reflecting member.

The reflecting member may be provided such that an angle formed between an optical axis of a reflecting surface adjacent to the light emitting element and the vertical axis is smaller than an angle formed between an optical axis of a reflecting surface remote from the light emitting element and the vertical axis.

The first diffusion portion may have a surface perpendicular to the predetermined angle in a direction opposite to the light emitting element.

The illumination apparatus may include a first reflecting member to reflect the light emitted from the light emitting element toward one direction and a second reflecting member to reflect the light traveling toward another direction among the light emitted from the light emitting element toward the first reflecting member.

In accordance with another aspect of the present disclosure, an illumination apparatus is installed in a storage chamber of a refrigerator, the illumination apparatus includes a light emitting element, an optical unit to allow the light emitted from the light emitting element to travel toward an inside of the storage chamber and prevent the light from traveling toward a front of the storage chamber, a wavelength converting unit disposed opposite to the light emitting element and to convert a wavelength of the light emitted from the light emitting element and a non-transmissive unit provided adjacent to the wavelength converting unit to prevent light emitted from the light emitting element from passing through the wavelength converting portion.

The illumination apparatus may include a first space formed between the wavelength converting unit and the light emitting element and a second space formed in a direction opposite to the first space with respect to the wavelength converting unit, wherein a cross-sectional area of the first space is smaller than a cross-sectional area of the second space.

The first space and the second space may be formed between the optical unit and the wavelength converting unit.

In accordance with still another aspect of the present disclosure, an illumination apparatus includes a light emitting element, an optical unit that allows light from the light emitting element to travel in one direction, and prevents the light from traveling in the other direction, a transmissive unit opposed to the light emitting element and transmitting light incident from the light emitting element, a wavelength converting unit disposed in a direction opposite to the light emitting element with respect to the transmissive unit to convert a wavelength of light incident on the transmissive unit and an output unit formed in the transmissive unit and outputting the light incident on the transmissive unit through the transmission unit without passing through the wavelength converting unit.

The transmissive unit may include an inclined portion inclined at a predetermined angle with respect to an optical axis of the light emitting element.

A degree of light diffusion in the output unit is larger than a degree of light diffusion in the inclined portion.

Advantageous Effects

In accordance with one aspect of the present disclosure, an inside of the storage chamber can be irradiated with a sufficient amount of light.

In addition, the illumination unit can brighten the inside of the storage chamber to improve the visibility of articles placed in the storage chamber.

BEST MODE

Hereinafter, an illumination unit and a refrigerator including the illumination unit according to the present disclosure will be described in detail with reference to the accompanying drawings.

Figure 1:
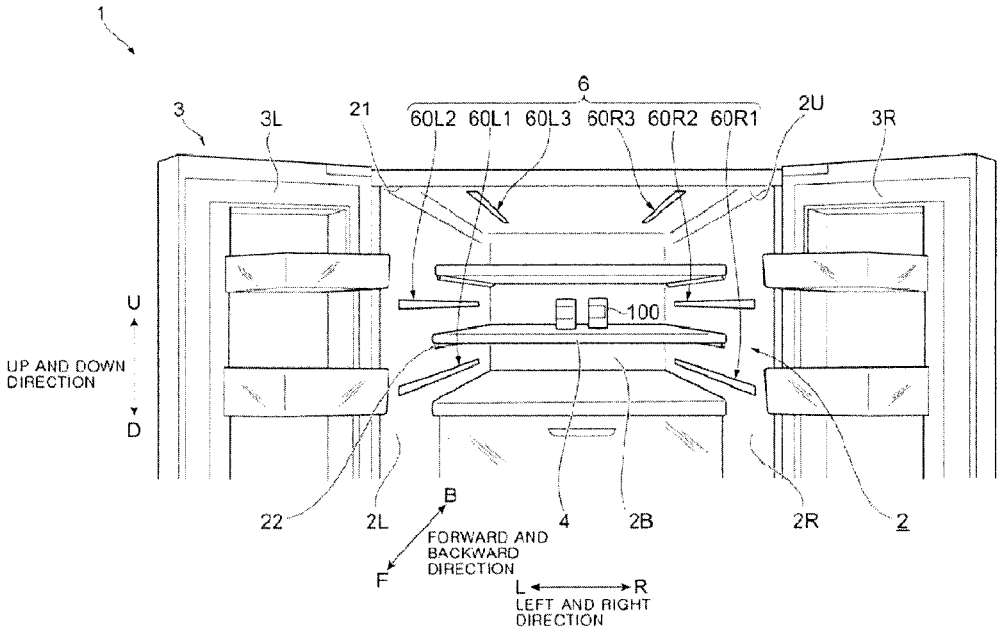
FIG. 1 is a view illustrating an interior of a refrigerator according to a first embodiment.

FIG. 1 is a view illustrating an interior of a refrigerator according to a first embodiment.

Referring to FIG. 1, a refrigerator 1 according to a first embodiment includes a storage chamber 2 for storing articles 100 and a door 3 for opening or closing the storage chamber 2. The refrigerator 1 may be provided with shelves 4 on which the articles 100 are placed and an illumination unit 6 illuminating an inside of the storage chamber 2. The refrigerator 1 also includes a cooler (not shown) for cooling the inside of the storage chamber 2 and a fan (not shown) for circulating the cool air in the storage chamber 2.

Hereinafter, when the refrigerator 1 shown in FIG. 1 are viewed from the front in forward and backward directions, a front side of the view is referred to as "front side (F)" and an inside of the view is referred to as "inner side (B)". A left side of the view is referred to as "left side (L)" and a right side of the view is referred to as "right side (R)" in the left and right direction of the refrigerator 1 shown in FIG. 1. An upper side of the view is referred to as "upper side (U)" and a lower side of the view is referred to as "lower side (D)" in the up and down direction of the refrigerator 1 shown in FIG. 1.

The storage chamber 2 has a left side surface portion 2L provided on the left side (L) and a right side surface portion 2R provided on the right side (R). The storage chamber 2 has an upper surface portion 2U formed on the upper side (U), a lower surface portion (not shown) formed on the lower side (D) and a rear surface portion 2B formed on the inner side (B) thereof. The storage chamber 2 is formed with an opening 21 on the front side (F) thereof. The storage chamber 2 is provided as a space for accommodating the articles 100 by the left side surface portion 2L, the right side surface portion 2R, the upper surface portion 2U, the lower surface portion (not shown) and the rear surface portion 2B.

The storage chamber 2 may be provided with protrusions 22 for supporting the shelves 4. Each of the protrusions 22 protrudes toward the inside of the storage chamber 2 and extends from the front side (F) toward the inner side (B). In this embodiment, a pair of protrusions 22 are formed on the left side surface portion 2L and the right side surface portion 2R, respectively.

In the refrigerator 1 of the present embodiment, the door 3 includes a left side door 3L provided on the left side (L) and a right side door 3R provided on the right side (R). The right side door 3R and the left side door 3L are rotatably provided on the front side (F) of the storage chamber 2. The door 3 opens or closes the opening 21.

Each of the shelves 4 is a plate shaped member. In the present embodiment, a plurality of shelves 4 are provided. The shelves 4 are supported by the protrusions 22. Each of the shelves 4 forms a surface for mounting the articles 100 in the storage chamber 2.

The illumination unit 6 includes a left first illumination unit 60L1 provided on the lower side (D) of the left side surface portion 2L and a left second illumination unit 60L2 provided on the upper side (U) of the left side surface portion 2L. The illumination unit 6 includes a right first illumination unit 60R1 provided on the lower side (D) of the right side surface portion 2R and a right second illumination unit 60R2 provided on the upper side (U) of the right side surface portion 2R. The illumination unit 6 includes a left third illumination unit 60L3 provided on the left side (L) of the upper surface portion 2U and a right third illumination unit 60R3 provided on the right side (R) of the upper surface portion 2U.

The left first illumination unit 60L1, the left second illumination unit 60L2, the left third illumination unit 60L3, the right first illumination unit 60R1, the right second illumination unit 60R2 and the right third illumination unit 60R3, each has the same structure. Hereinafter, when they are not particularly distinguished, they are all referred to as the "illumination unit 60".

Figure 2:
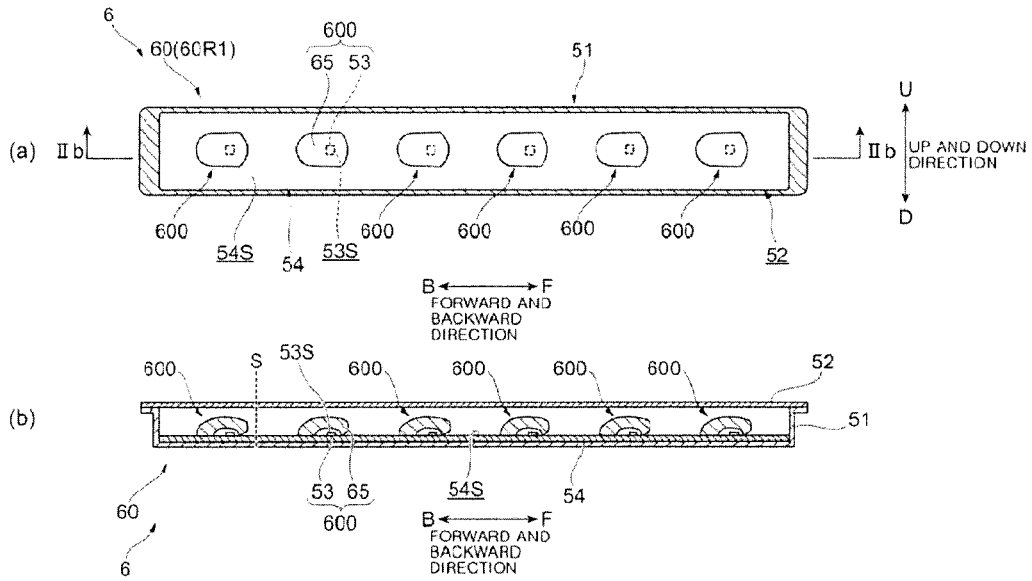
FIGS. 2A and 2B are views illustrating an illumination unit according to the first embodiment.

FIGS. 2A and 2B are views illustrating an illumination unit according to the first embodiment.

FIG. 2A illustrates the right first illumination unit 60R1 as an example of the illumination unit 60 and FIG. 2B illustrates a cross section of the illumination unit 60 shown in FIG. 2A along a line IIb-IIb.

Figure 3:
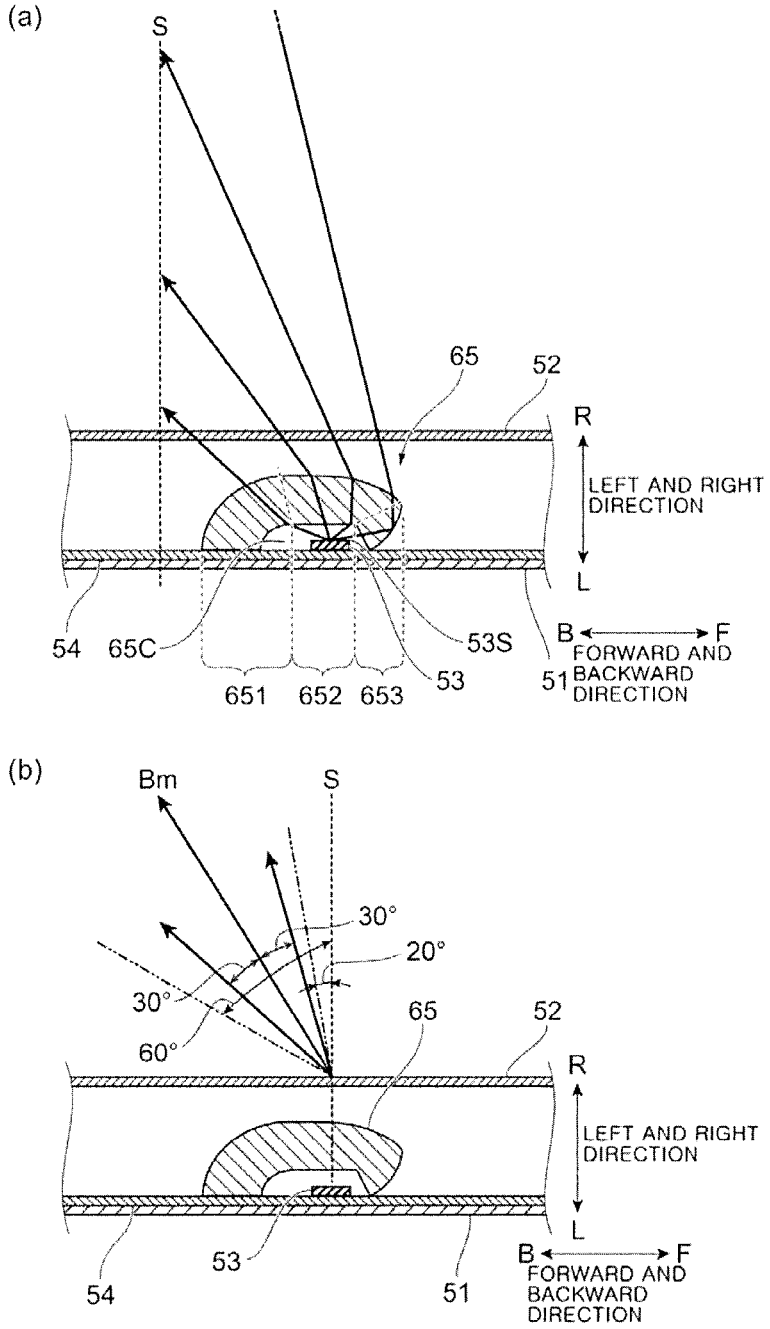
FIGS. 3A and 3B are views illustrating a lens member according to the first embodiment.

FIGS. 3A and 3B are views illustrating a lens member according to the first embodiment.

FIGS. 3A and 3B are views are cross-sectional views, respectively, of the illumination unit 60 cut in the forward and backward direction.

As shown in FIGS. 2A and 2B, the illumination unit 60 includes a case 51 and a cover member 52 to cover the case 51. The illumination unit 60 includes a plurality of LEDs (Light Emitting Diodes) 53 to emit light, a substrate 54 on which the LEDs 53 are mounted and a lens member 65 to control light emitted from the LEDs 53.

The case 51, as shown in FIG. 2A, is a box-shaped member having an opening. The case 51 may accommodate the plurality of LEDs 53 and the substrate 54 inside thereof. For example, the case 51 may be embedded in the right side surface portion 2R of the storage chamber 2 or the like.

The cover member 52, as shown in FIG. 2B, covers the opening of the case 51. The cover member 52 may block the LEDs 53, the substrate 54 and the lens member 65 from the outside of the case 51. The cover member 52 may be manufactured using a resin such as PC (polycarbonate) or PMMA (polymethyl methacrylate resin), glass, or the like. The cover member 52 is provided to be transparent so as to allow light emitted from the LEDs 53 to pass through.

The cover member 52 may be provided in a white color so as to have a diffusion characteristic, or a lens-cut process or a paint process may be performed on an inner side or an outer side of the cover member 52.

The LEDs 53 include all kinds of LEDs that may illuminate the articles 100 in the storage chamber 2. The LEDs 53 may emit white light. In detail, the LEDs 53 of this embodiment are provided to emit white light by a blue light emitting diode, a fluorescent material for converting blue light into green light, and a fluorescent material for converting blue light into red light. The LEDs 53 are attached such that major surfaces 53S of the LEDs 53 are disposed along each of surfaces of the storage chamber 2 (for example, the left side surface portion 2L and the upper surface portion 2U).

A major light emitting direction of light emitted from the LEDs 53 is a direction perpendicular to each of the surfaces of the storage chamber 2 (hereinafter referred to as "vertical axis S").

The substrate 54 may be formed in a rectangular shape. The substrate 54 supplies power to the LEDs 53. The substrate 54 is electrically connected to a controller (not shown) for controlling the light emission of the LEDs 53. The substrate 54 is attached such that a major surface 54S of the substrate 54 is disposed along each of the surfaces of the storage chamber 2 (for example, the left side surface portion 2L and the upper surface portion 2U).

As described above, in the present embodiment, the major surface 53S of the LEDs 53 or the major surface 54S of the substrate 54 are disposed along each of the surfaces of the storage chamber 2 (for example, the left side surface portion 2L, the upper surface portion 2U, and the like). Accordingly, the amount of the illumination unit 60 protruding toward the central side of the storage chamber 2 is reduced, and the illumination unit 60 is compact.

The lens member 65 is provided for each of the plurality of the LEDs 53 (six LEDs in this embodiment) as shown in FIGS. 2A and 2B. In the first embodiment, light of a single LED 53 is guided by a single lens member 65. The light distribution may be controlled so that light emitted from the LED 53 is directed toward the inner side (B) of the storage chamber 2 and is prevented from traveling toward the front side (F).

In this embodiment, the lens member 65 may be manufactured using a resin such as PC (polycarbonate resin), PMMA (polymethyl methacrylate resin), glass, or the like.

In the present embodiment, the prevention of the traveling of light toward the front side (F) represents that the light of the LED 53 does not travels to the front side (F) at an angle larger than 0° with respect to the vertical axis S passing through the LED 53.

Hereinafter, a unit formed by a single lens member 65 and a single LED 53 will be referred to as a "light source 600".

The lens member 65, as shown in FIG. 3A may be provided such that a hollow portion 65C is formed in the cross-sectional surface thereof. The lens member 65 accommodates the LED 53 inside the hollow portion 65C. Hereinafter, a surface formed on the same side of the hollow portion 65C is referred to as the "inner surface" of the lens member 65, and a surface on the opposite side is referred to as the "outer surface" of the lens member 65.

As shown in FIG. 3A, the lens member 65 may be divided into a plurality of areas as a configuration for controlling the light distribution by polarizing the light from the LED 53. For example, the lens member 65 may be divided into three areas. A first area 651, a second area 652, and a third area 653 may be sequentially positioned in the lens member 65 from the inner side (B) toward the front side (F).

The first area 651 is an area formed at the inner side (B) with respect to the LED 53. The first area 651 has a substantially arc-shaped cross section on both the inner surface and the outer surface. Therefore, among light radially irradiated from the LED 53, the light incident on the first area 651 generally advances toward the inner side (B) while maintaining an irradiated angle from the LED 53.

The second area 652 is an area formed at the substantially central portion in the front side (F) and the inner side (B) direction with respect to the LED 53. The second area 652 has a cross section substantially parallel to the major surface 53S of the LED 53 on both the inner and outer surfaces. The outer surface of the second area 652 is gradually inclined so that the protruding height is lowered from the inner side (B) toward the front side (F).

Therefore, among light radially irradiated from the LED 53, the light incident on the second area 652 is refracted at a predetermined angle and proceeds toward the inner side (B).

The third area 653 is an area formed at the front side (F) with respect to the LED 53. The inner surface of the third area 653 may be formed to have a straight line in cross section. The inner surface of the third area 653 is formed so as to have an acute angle with respect to the substrate 54. The outer surface of the third area 653 is circular in shape, and has an acute angle with respect to the substrate 54.

Therefore, among light radiated from the LED 53, the light incident on the third area 653 is totally-reflected on the outer surface of the third area 653, and does not travel toward the front side (F).

The lens member 65, as shown in FIG. 3A allows a uniform illuminance at the imaginary plane which appears to be the vertical axis S perpendicular to and extending from the substrate 54. Particularly, the lens member 65 controls the light distribution so that the illuminance in the left and right direction of the rear surface portion 2B becomes uniform. In addition, the lens member 65 makes the illuminance to be uniform in the entire area of the storage chamber 2 and allows the entire area in the storage chamber 2 to be illuminated.

The lens member 65 controls the light emitted from the LED 53 so that a direction of a light beam having the maximum luminance (hereinafter referred to as "optical axis Bm" in this embodiment) as shown in FIG. 3B is not less than 20° and not more than 60° with respect to the vertical axis S.

As shown in FIG. 3B, the lens member 65 of this embodiment forms a light distribution angle of ±30° (Narrow angle) with respect to the optical axis Bm. Further, the lens member 65 forms a light distribution pattern of a substantially conical shape with the optical axis Bm as center of rotation. That is, each of the lens members 65 irradiates a spot light.

The number of the lens members 65 is not particularly limited and may be appropriately set according to the total luminous intensity of the LED 53, the size of the refrigerator, and the like.

Figure 4:
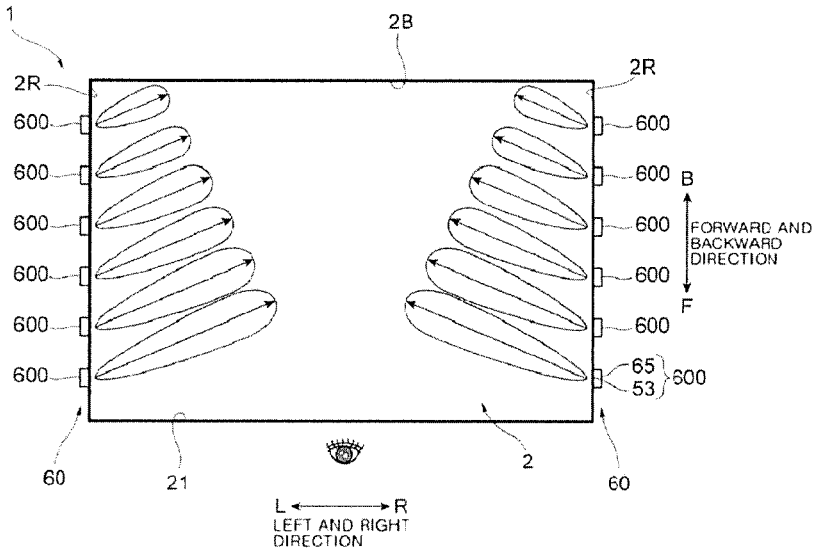
FIG. 4 is a view for explaining features of the illumination unit according to the first embodiment.

FIG. 4 is a view for explaining features of the illumination unit according to the first embodiment.

A conceptual diagram of the luminous intensity of each light source 600 installed in the illumination unit 60 is shown in FIG. 4.

Referring to FIG. 4, the plurality of light sources 600 in the illumination unit 60 may be arranged so that the luminous intensity of the light source 600 increases from the front side (F) to the inner side (B). The luminous intensity of the light source 600 located at the inner side (B), which is the rear surface portion 2B in the illumination unit 60, is smaller than that of the light source 600 located at the front side (F). As described above, in the first embodiment, the light source 600 positioned on the front side (F) may be set to be larger than the light intensity of the light source 600 positioned on the inner side (B).

With this configuration, the illuminance of the rear surface portion 2B may be made uniform in the entire area of the rear surface portion 2B.

In the first embodiment, the illumination unit 60 is provided so as to extend from the front side (F) to the inner side (B). It is also possible to embed and attach the illumination unit 60 to the protrusions 22 (see FIG. 1) that extend from the front side (F) toward the inner side (B). The protrusions 22 perform a function of supporting the shelf 4 and another function of forming a part of the illumination unit 60.

Figure 5:
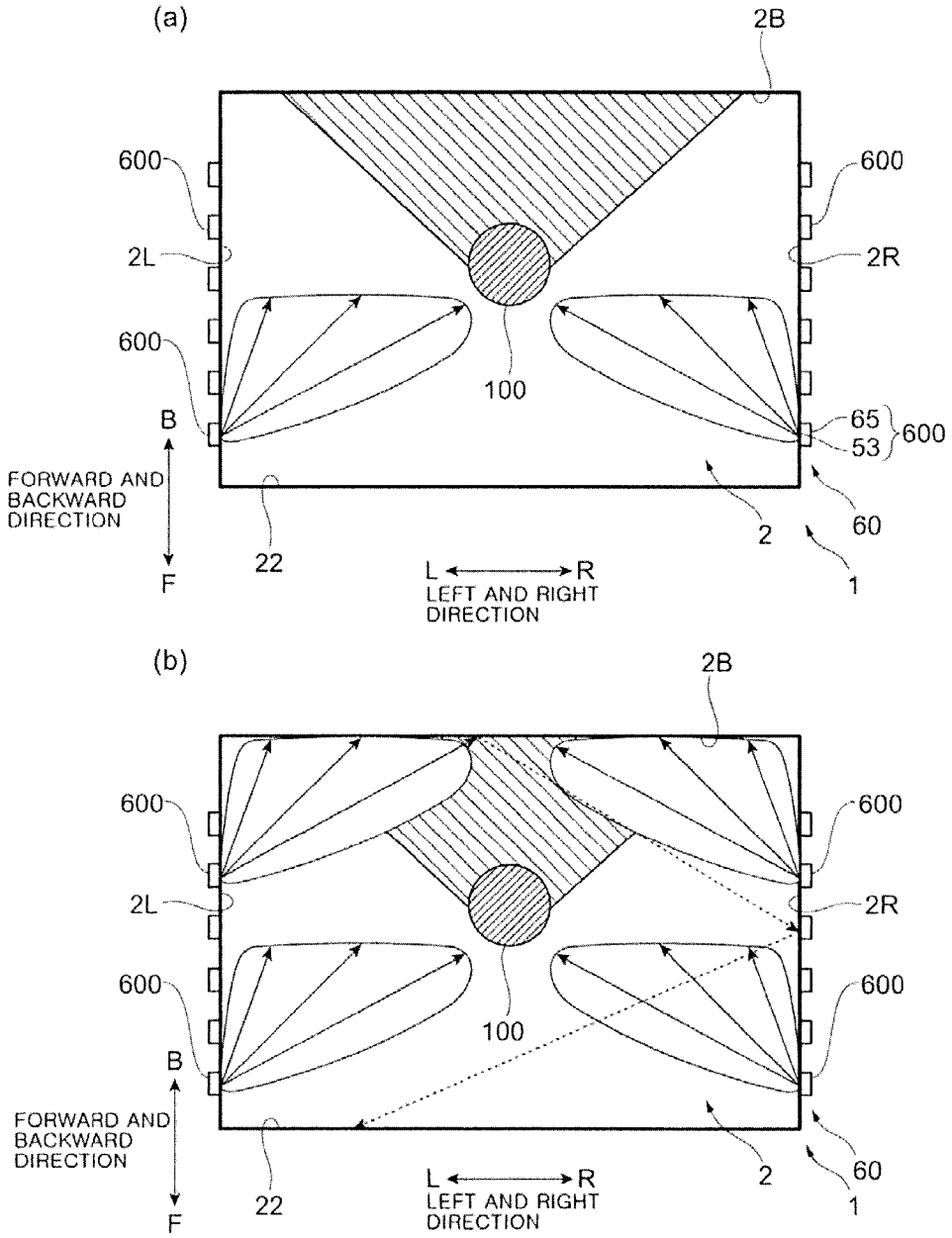
FIGS. 5A and 5B are views for explaining an operation of the illumination unit according to the first embodiment.

FIGS. 5A and 5B are views for explaining an operation of the illumination unit according to the first embodiment.

Hereinafter, the visibility of the articles 100 in the storage chamber 2 of the refrigerator 1 according to the first embodiment and the brightness in the storage chamber 2 will be described in detail.

The illumination unit 60 of the present embodiment, as shown in FIG. 5A includes a plurality of light sources 600 that are installed toward the inner side (B) from the front side (F) of the storage chamber 2. The article 100 is illuminated from the front side (F) by the light sources 600 positioned on the front side (F). The article 100 may be easily seen by the light emitted from the light sources 600 on the front side (F). When the article 100 is illuminated by the light sources 600 on the front side (F), shadows may be generated on the inner side (B) of the article 100.

In this embodiment, as shown in FIG. 5B, the light sources 600 are also disposed on the inner side (B). The light sources 600 positioned on the inner side (B) illuminate the shadow placed on the inner side (B) of the article 100. As a result, a user feels the storage chamber 2 bright as a whole. In particular, since the rear surface portion 2B is bright, a user feels the storage chamber 2 bright as a whole by the light diffused and reflected from the rear surface portion 2B.

In this embodiment, as shown in FIG. 1, the upper surface portion 2U of the storage chamber 2 is also provided with the left third illumination unit 60L3 and the right third illumination unit 60R3, each having a plurality of light sources 600 arranged side by side from the front side (F) toward the inner side (B). The configuration and effect of the illumination unit 60 may be similarly applied to the left third illumination unit 60L3 and the right third illumination unit 60R3.

The illumination unit 60 of the present embodiment is set such that an angle of the optical axis Bm is twenty degrees or more and sixty degrees or less with respect to the vertical axis S. The light emitted from the illumination unit 60 may be reflected a plurality of times on each of the surfaces (the rear surface portion 2B, the left side surface portion 2L, and the right side surface portion 2R) forming the storage chamber 2. For example, as shown by the broken-line arrows in FIG. 5B, the light reflected by the rear surface portion 2B may again illuminate the right side surface portion 2R. Light may be diffused and reflected on the rear surface portion 2B or the right side surface portion 2R. Therefore, a user feels bright on each surface. Meanwhile, diffusion and reflection are performed on each surface, and light does not directly proceed from the LED 53, so that a user does not feel glare by the light.

Light emitted from the LED 53 does not proceed directly from the illumination unit 60 toward the opening 21 on the front side (F) where a user is located. Therefore, in the refrigerator 1 according to the first embodiment, user's glare is prevented from occurring, and the visibility of the article 100 can be improved.

Hereinafter, the refrigerator 1 according to the second embodiment will be described. In the case of the refrigerator 1 according to the second embodiment, the components similar to those of the first embodiment are denoted by the same reference numerals, and the detailed description of the components similar to those of the first embodiment will be omitted.

Figure 6:
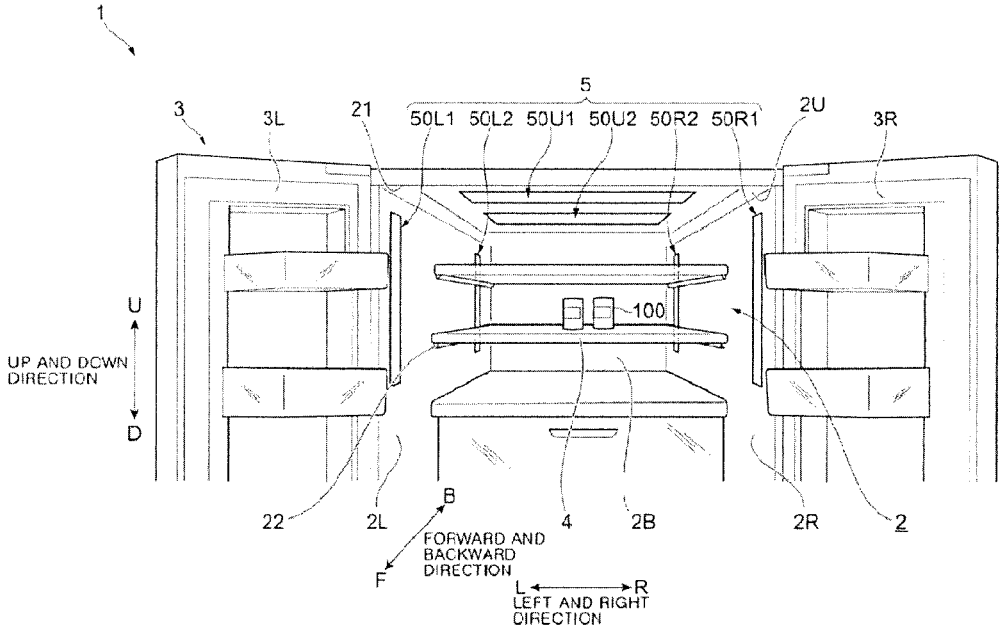
FIG. 6 is a view illustrating an interior of a refrigerator according to a second embodiment.

FIG. 6 is a view illustrating an interior of a refrigerator according to a second embodiment.

Referring to FIG. 6, a refrigerator 1 of a second embodiment includes a storage chamber 2 for storing articles 100, a door 3 for opening or closing the storage chamber 2, shelves 4 on which the articles 100 are placed, and an illumination unit 5 illuminating an inside of the storage chamber 2. The refrigerator 1 also includes a cooler (not shown) for cooling the inside of the storage chamber 2 and a fan (not shown) for circulating the cool air in the storage chamber 2.

The illumination unit 5 of the refrigerator 1 according to the second embodiment is different from the illumination unit 6 of the first embodiment. Hereinafter, the illumination unit 5 according to the second embodiment will be described in detail.

The illumination unit 5 includes a left first illumination unit 50L1 provided on the front side (F) of the left side surface portion 2L and a left second illumination unit 50L2 provided on the inner side (B) of the left side surface portion 2L. The illumination unit 5 includes a right first illumination unit 50R1 provided on the front side (F) of the right side surface portion 2R and a right second illumination unit 50R2 provided on the inner side (B) of the right side surface portion 2R. The illumination unit 5 includes an upper first illumination unit 50U1 provided on the front side (F) of the upper surface portion 2U and an upper second illumination unit 50U2 provided on the inner side (B) of the upper surface portion 2U.

The left first illumination unit 50L1, the left second illumination unit 50L2, the right first illumination unit 50R1, the right second illumination unit 50R2, the upper first illumination unit 50U1 and the upper second illumination unit 50U2, each has the same structure. Hereinafter, when they are not particularly distinguished, they are all referred to as the "illumination unit 50".

As shown in FIG. 6, the illumination units 50 are disposed on the front side (F) (near the opening 21) and the inner side (B) (near the rear surface portion 2B) of the left side surface portion 2L, the right side surface portion 2R and the upper surface portion 2U of the refrigerator 1 of the present embodiment.

Figure 7:
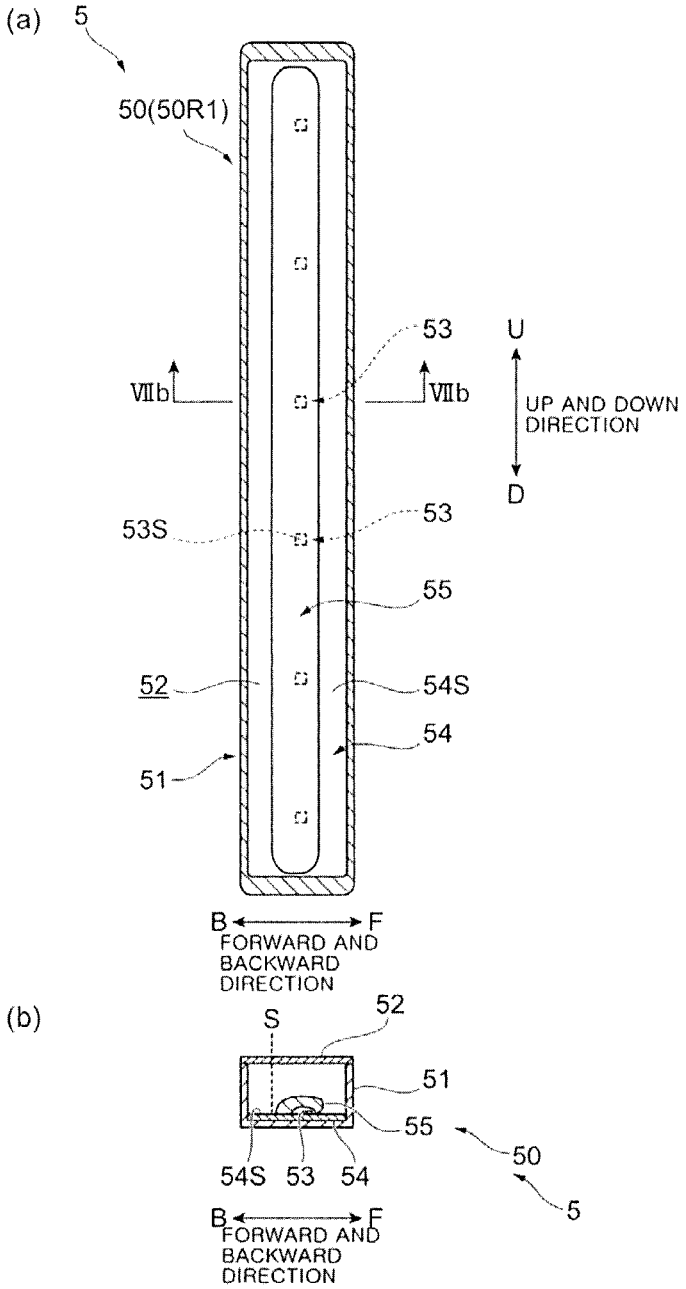
FIGS. 7A and 7B are views illustrating an illumination unit according to the second embodiment.

FIG. 7 part (a) and part (b) is a view illustrating an illumination unit according to the second embodiment.

FIG. 7A illustrates the right first illumination unit 50R1 as an example of the illumination unit 50 and FIG. 7B illustrates a cross section of the illumination unit 50 shown in FIG. 7A along a line VIIb-VIIb.

Figure 8:
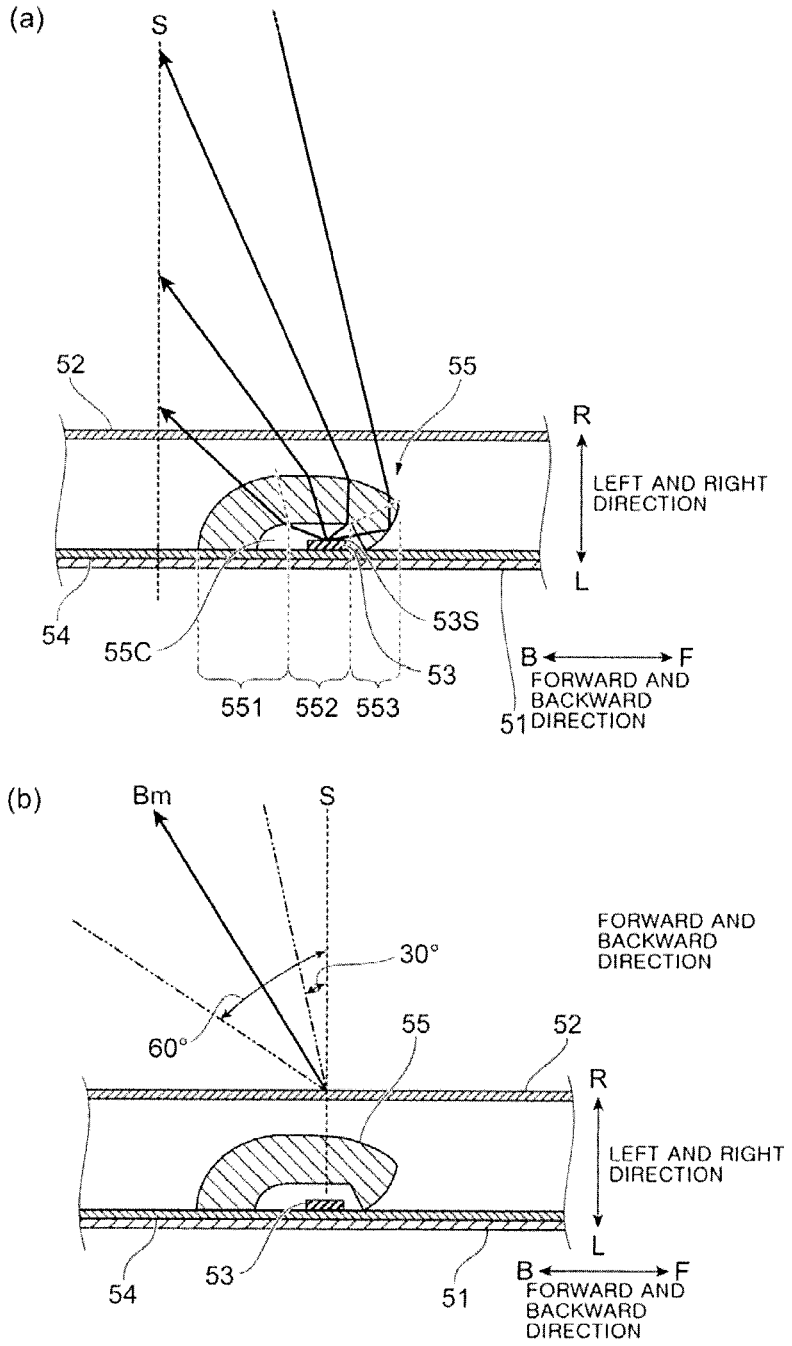
FIGS. 8A and 8B are views illustrating a lens member according to the second embodiment.

FIGS. 8A and 8B are views illustrating a lens member according to the second embodiment.

FIGS. 8A and 8B are cross-sectional views, respectively, of the illumination unit 50 cut in the forward and backward direction.

As shown in FIGS. 7A and 7B, the illumination unit 50 includes a case 51 and a cover member 52 to cover the case 51. The illumination unit 60 includes a plurality of Light Emitting Diodes (LEDs) 53 to emit light, a substrate 54 on which the LEDs 53 are mounted and a lens member 55 to guide light emitted from the LEDs 53.

As shown in FIG. 7A, the lens member 55 may be extended in one direction. Specifically, in the left side surface portion 2L and the right side surface portion 2R (see FIG. 6), the lens member 55 extends along the up and down direction. In the upper surface portion 2U (see FIG. 6), the lens member 55 extends along the left and right direction.

In this embodiment, the illumination unit 50 includes a plurality of LEDs 53 and a single lens member 55. The lens member 55 collectively controls the light distribution of the light emitted from the plurality of LEDs 53. The lens member 55 controls the light distribution of the light emitted from the LEDs 53 to allow the light emitted from the LEDs 53 to be directed toward the inner side (B) of the storage chamber 2 and to prevent the light emitted from the LEDs 53 from traveling toward the front side (F).

In this embodiment, the lens member 55 may be manufactured using a resin such as polycarbonate resin (PC), polymethyl methacrylate resin (PMMA), glass, or the like.

The lens member 55, as shown in FIG. 8A may be provided such that a hollow portion 55C is formed in the cross-sectional surface thereof. The lens member 55 accommodates the LED 53 inside the hollow portion 55C. Hereinafter, a surface formed on the same side of the hollow portion 55C is referred to as the "inner surface" of the lens member 55, and a surface on the opposite side is referred to as the "outer surface" of the lens member 55.

The lens member 55 has three areas for controlling light distribution by polarizing light from the LED 53. That is, the lens member 55 includes a plurality of areas. The lens member 55 includes a first area 551, a second area 552, and a third area 553. The first area 551, the second area 552, and the third area 553 may be sequentially positioned from the inner side (B) toward the front side (F).

The first area 551, the second area 552 and the third area 553 of the second embodiment, each has a similar function to the first area 651, the second area 652 and the third area 653 of the first embodiment, respectively. The lens member 55 of the illumination unit 50 according to the second embodiment also allows the light emitted from each LED 53 to proceed toward the inner side (B) and prevents the light emitted from each LED 53 from proceeding toward the front side (F).

The lens member 55, as shown in FIG. 8A makes the illuminance at the imaginary plane to form the vertical axis S uniform. The lens member 55 controls the light distribution so that the illuminance in the left and right direction of the rear surface portion 2B becomes uniform. In addition, the lens member 55 makes the illuminance to be uniform in the entire area of the storage chamber 2 and allows the entire area in the storage chamber 2 to be illuminated.

The lens member 55, as shown in FIG. 8B controls the light emitted from the LED 53 so that the optical axis Bm is not less than 30° and not more than 60° with respect to the vertical axis S.

Figure 9:
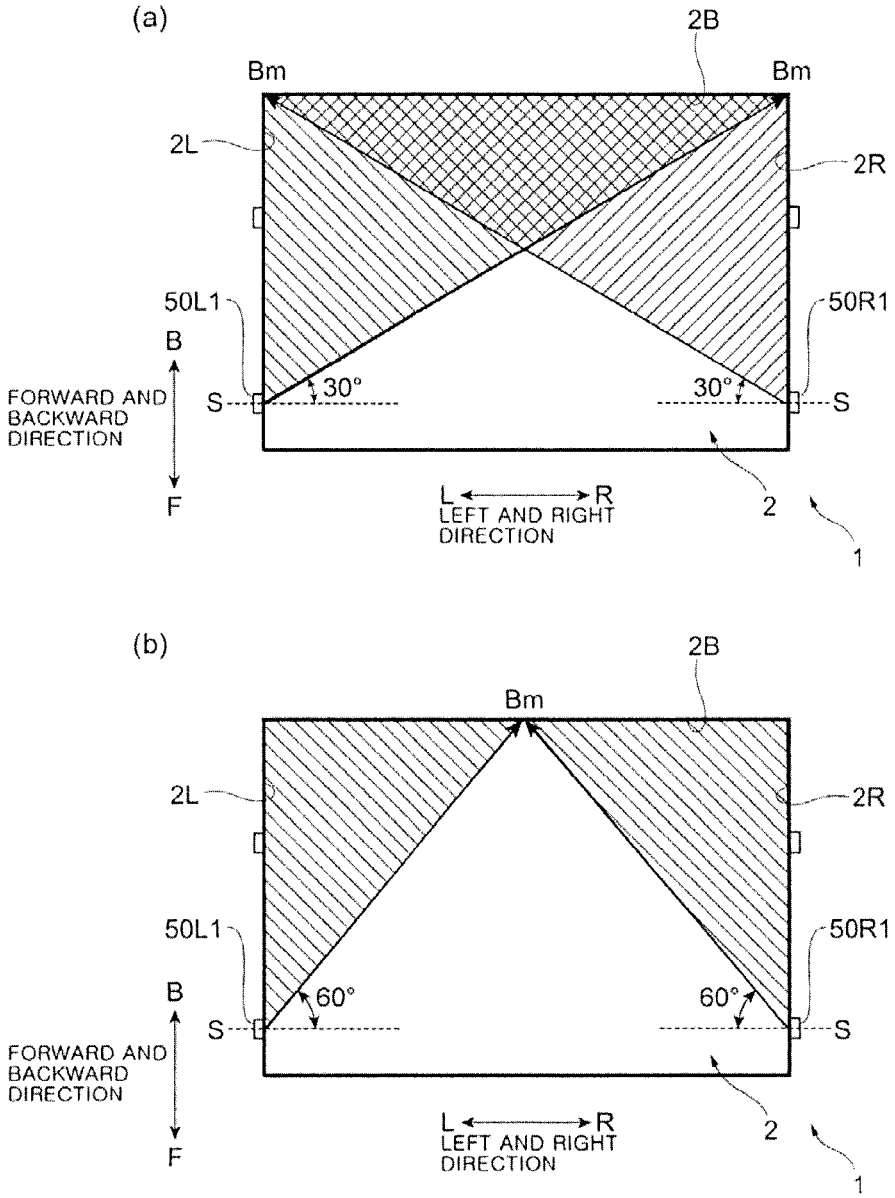
FIGS. 9A and 9B are views for explaining features of the illumination unit according to the second embodiment.

FIGS. 9A and 9B are views for explaining features of the illumination unit according to the second embodiment.

In the present embodiment, an angle of the light with the maximum luminance is within a range of 30 degrees to degrees with respect to the vertical axis S, so that the illuminance of the rear surface portion 2B in the left and right direction is made uniform. Hereinafter, as shown in FIGS. 9A and 9B, the case where an angle of the optical axis Bm with respect to the vertical axis S in the left first illumination unit 50L1 is set to 30 degrees or more and 60 degrees or less and an angle of light having a maximum luminance in the right first illumination unit 50R1 is set to 30 degrees or more and 60 degrees or less will be described.

First, as shown in FIG. 9A, the case where the angle of the optical axis Bm with respect to the vertical axis S is set to 30 degrees will be described. In this case, the optical axis Bm of the left first illumination unit 50L1 is directed toward a corner of the right side R in the rear surface portion 2B. A range illuminated by the left first illumination unit 50L1 covers the rear surface portion 2B in the left and right direction. The optical axis Bm of the right first illumination unit 50R1 is directed toward a corner of the left side L in the rear surface portion 2B. A range illuminated by the right first illumination unit 50R1 covers the rear surface portion 2B leftward and rightward.

As shown in FIG. 9B, the case where the angle of the optical axis Bm with respect to the vertical axis S is set to 60 degrees will be described. In this case, the optical axis Bm of the left first illumination unit 50L1 is directed toward a center of the rear surface portion 2B in the left and right direction. A range illuminated by the left first illumination unit 50L1 covers from the center of the rear surface portion 2B to the corner of the left side L. The optical axis Bm of the right first illumination unit 50R1 is directed toward a center of the rear surface portion 2B in the left and right direction. A range illuminated by the right first illumination unit 50R1 covers from the center of the rear surface portion 2B to the corner of the right side R.

As shown in FIG. 9A, the ranges of light irradiation of the left first illumination unit 50L1 and the right first illumination unit 50R1 covering the rear surface portion 2B when the angle of the optical axis Bm is 30 degrees are wider than the ranges of light irradiation of the left first illumination unit 50L1 and the right first illumination unit 50R1 covering the rear surface portion 2B when the angle of the optical axis Bm is 60 degrees. Therefore, when the angle of the optical axis Bm is 30 degrees, the rear surface portion 2B is illuminated by the light of both the left first illumination unit 50L1 and the right first illumination unit 50R1.

As shown in FIG. 9B, the ranges of light irradiation of the left first illumination unit 50L1 and the right first illumination unit 50R1 covering the rear surface portion 2B when the angle of the optical axis Bm is 60 degrees are narrower than the ranges of light irradiation of the left first illumination unit 50L1 and the right first illumination unit 50R1 covering the rear surface portion 2B when the angle of the optical axis Bm is 30 degrees. When the angle of the optical axis Bm is 60 degrees, one half of the rear surface portion 2B is illuminated by the left first illumination unit 50L1 and the other half of the rear surface portion 2B is illuminated by the right first illumination unit 50R1.

Therefore, the illuminance of the rear surface portion 2B when the angle of the optical axis Bm is 30 degrees and the illuminance of the rear surface portion 2B when the angle of the optical axis Bm is 60 degrees is equivalent.

As described above, the illumination unit 50 of the second embodiment may be set so that the angle of the optical axis Bm of the illumination unit 50 with respect to the vertical axis S is 30 degrees or more and 60 degrees or less. The optical axis Bm may be in the range from the corner of the left side L of the rear surface portion 2B or from the corner of the right side R of the rear surface portion 2B to the center of the rear surface portion 2B. As described above, the illuminance of the rear surface portion 2B is uniform regardless of the angle of the optical axis Bm.

In this embodiment, the illumination unit 50 uniformly illuminates the rear surface portion 2B.

Generally, the ratio between the length in the left and right direction and the length in the forward and backward direction (so-called aspect ratio) is similar regardless of the size (capacity) of the refrigerator 1. Therefore, the above-described numerical range may be applied regardless of the size (capacity) of the refrigerator 1.

Hereinafter, the refrigerator 1 according to the third embodiment will be described. In the third embodiment, components similar to those of the other embodiments are denoted by the same reference numerals, and detailed description thereof is omitted.

Figure 10:
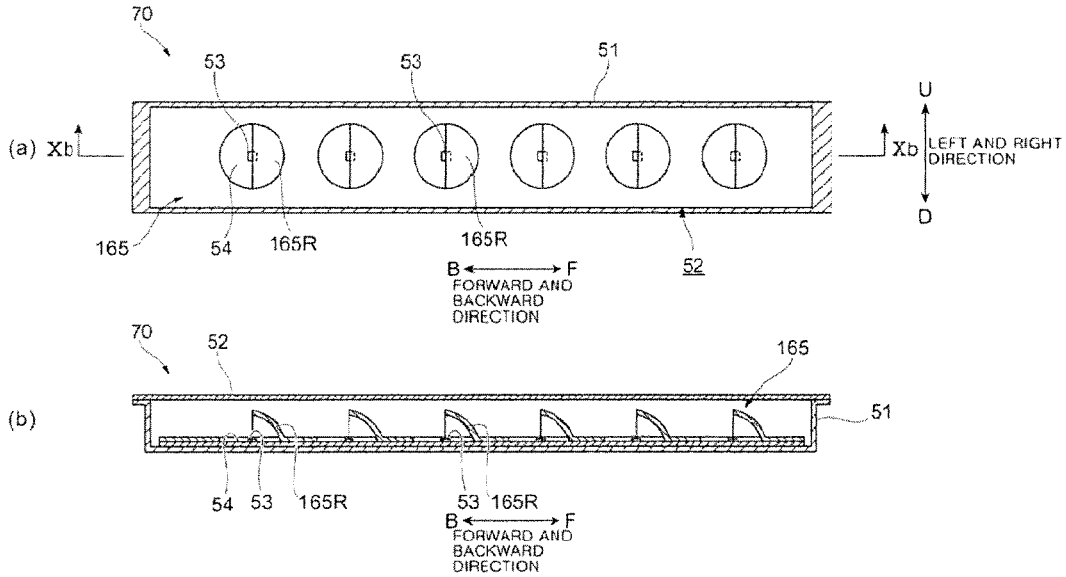
FIGS. 10A and 10B are views illustrating an illumination unit according to the third embodiment.

FIGS. 10A and 10B are views illustrating an illumination unit according to the third embodiment.

FIG. 10A is a view of the illumination unit 70 viewed from one of the left and right directions, and FIG. 10B is a cross-sectional view of the illumination unit 70 shown in FIG. 10A along a line Xb-Xb.

The refrigerator 1 of the third embodiment has an illumination unit 70 similar to the illumination unit 60 instead of the illumination unit 60 of the first embodiment. The illumination unit 70 has a reflecting member 165 instead of the lens member 65 of the illumination unit 60 of the first embodiment. Hereinafter, the reflecting member 165 will be described in detail.

The reflecting member 165 includes a plurality of reflecting portions 165R. Each of the reflecting portions 165R is provided in a dome shape of a semicircular arc. The reflecting portion 165R is disposed on the front side (F) of the LED 53 and the reflecting portion 165R is provided with an opening facing the inner side (B). The surface of the reflecting portion 165R may include a material that reflects light in at least a visible light region among wavelengths of light emitted by the LED 53. A plurality of reflecting portions 165R are provided so as to be provided in the plurality of LEDs 53, respectively.

In the third embodiment, each of the reflecting portions 165R allows the light emitted from the LED 53 to be directed to the inner side (B) of the storage chamber 2 and prevents the light emitted from the LED 53 from advancing toward the front side (F). In this case, an angle of the optical axis Bm may be set to be within a range of 30 degrees to 60 degrees with respect to the vertical axis S.

Similarly to the lens member 65 of the first embodiment, the reflecting member 165 forms a light distribution pattern having a shape symmetrical with respect to the optical axis Bm (light beam of maximum luminance). More specifically, the reflecting member 165 forms a light distribution pattern of a substantially conical shape in which a light distribution angle becomes a narrow angle.

The illumination unit 70 of the third embodiment configured as described above allows a user to feel the inside of the storage chamber 2 bright. The illumination unit 70 of the third embodiment realizes the hunt effect by the irradiation of the spot light by the illumination unit 70 so that the article 100 may be clearly seen.

The reflecting portion 165R prevents the light emitted from the LED 53 from advancing toward the front side (F). Since the light emitted from the LED 53 does not travel toward the opening 21 where a user is located, glare is reduced and the user can find the article 100 in the storage chamber 2 more easily.

The reflecting member 165 of the third embodiment may be applied in place of the lens member 55 of the illumination unit 50 of the second embodiment.

Hereinafter, the refrigerator 1 according to the fourth embodiment will be described. In the fourth embodiment, components similar to those of the other embodiments are denoted by the same reference numerals, and detailed description thereof is omitted.

Figure 11:
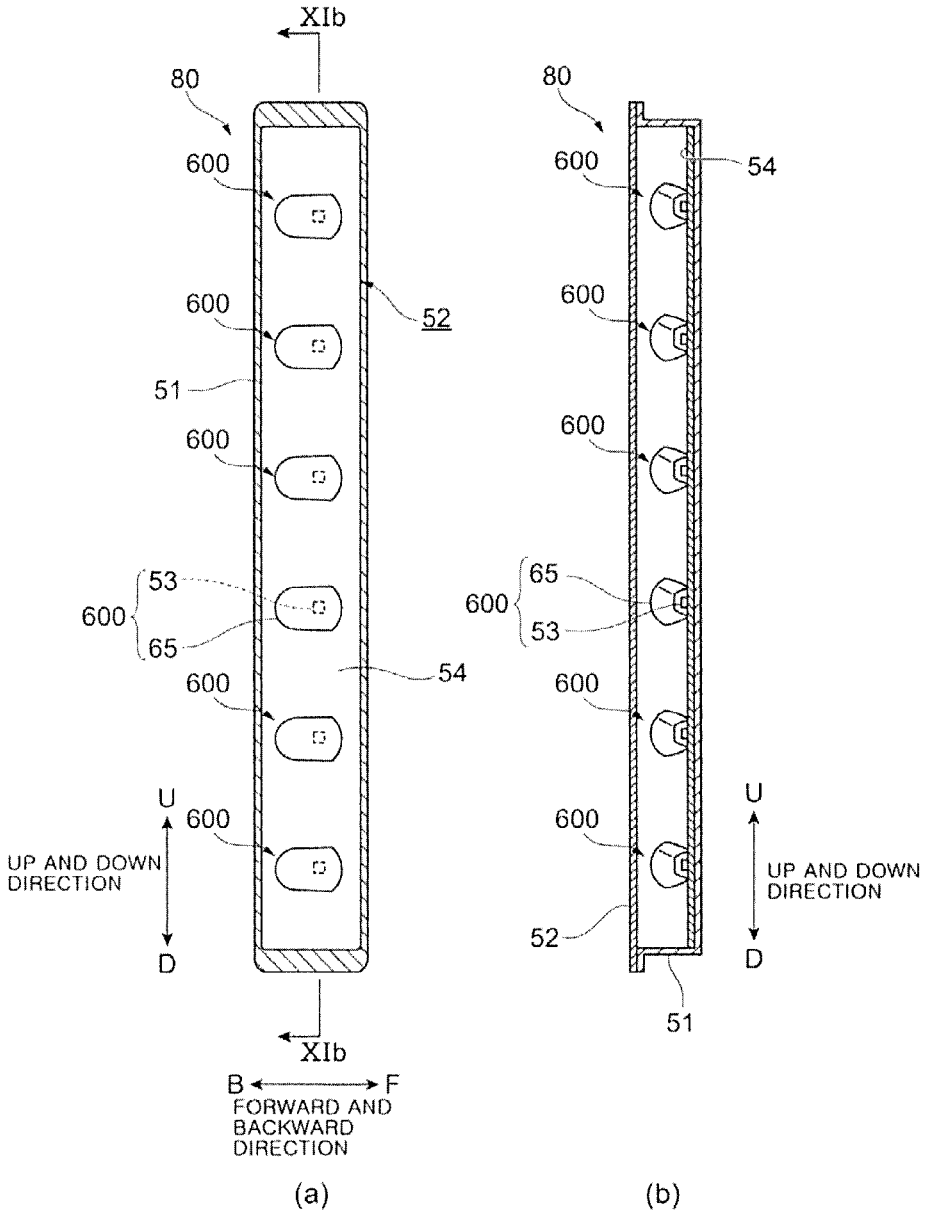
FIGS. 11A and 11B are views illustrating an illumination unit according to the fourth embodiment.

FIGS. 11A and 11B are views illustrating an illumination unit according to the fourth embodiment.

FIG. 11A is a view of the illumination unit 80 viewed from one of the left and right directions, and FIG. 11B is a cross-sectional view of the illumination unit 80 shown in FIG. 11A along a line XIb-XIb.

The refrigerator 1 of the fourth embodiment includes an illumination unit 80 having a configuration similar to that of the illumination unit 50 of the second embodiment, instead of the illumination unit 50 of the second embodiment.

The illumination unit 80 includes a plurality of light sources 600, and the light sources 600 are arranged to extend in the up and down direction. Each of the light sources 600 includes an LED 53 and a lens member 65. In the illumination unit 80, each of the light sources 600 allows the light emitted from the LED 53 to be directed to the inner side (B) of the storage chamber 2 and prevents the light emitted from the LED 53 from advancing toward the front side (F).

In each light source 600, the lens member 65 controls the light distribution so that an angle of the optical axis Bm may be set to be within a range of 30 degrees to 60 degrees with respect to the vertical axis S.

In each light source 600, the lens member 65 forms a light distribution pattern in which the optical axis Bm (light beam with maximum luminance) is rotationally symmetrical. More specifically, the lens member 65 forms a light distribution pattern of a substantially conical shape in which a light distribution angle becomes a narrow angle.

The entire interior of the storage chamber 2 can be brighter by the illumination unit 80 of the fourth embodiment. The illumination unit 80 of the fourth embodiment allows the article 100 to be clearly seen by a spot light distribution pattern. And by the illumination unit 80, glare is reduced and a user can find the article 100 in the storage chamber 2 more easily.

Hereinafter, the refrigerator 1 according to the fifth embodiment will be described. In the fifth embodiment, components similar to those of the other embodiments are denoted by the same reference numerals, and detailed description thereof is omitted.

Figure 12:
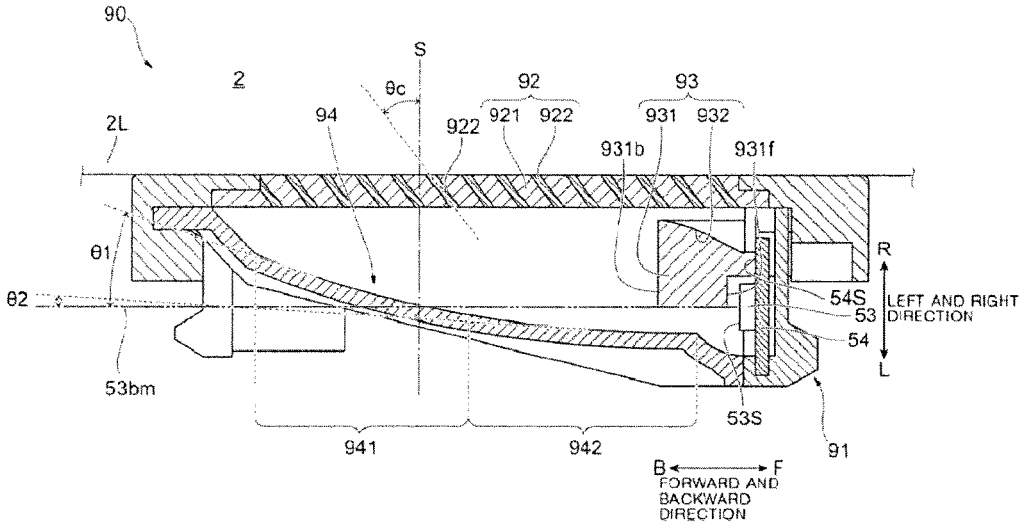
FIG. 12 is a view illustrating an illumination unit according to the fifth embodiment.

FIG. 12 is a view illustrating an illumination unit according to the fifth embodiment.

The refrigerator 1 of the fifth embodiment has an illumination unit 90 instead of the illumination unit 50 (see FIG. 6) of the second embodiment.

As shown in FIG. 12, the illumination unit 90 includes an LED 53, a substrate 54, and a case 91. The illumination unit 90 includes a cover member 92 for covering the case, a polarizing lens member 93 for adjusting the light emitted from the LED 53, and a reflecting member 94 for reflecting the light emitted from the LED 53.

The illumination unit 90 of the fifth embodiment includes the LED 53 emitting light (an example of the light emitting device) and the polarizing lens member 93 (an example of the optical member) which allows the light emitted from the LED 53 to be directed to the inner side (B) of the storage chamber 2 and prevents the light emitted from the LED 53 from advancing toward the front side (F). The illumination unit 90 illuminates the inside of the storage chamber 2.

In the fifth embodiment, the LED 53 and the substrate 54 are provided so that main surfaces 53S and 54S are parallel to the vertical axis S. The optical axis 53*bm* of the LED 53 is parallel to the forward and backward direction of the left side surface portion 2L (the right side surface portion 2R and the upper surface portion 2U as well) of the storage chamber 2.

The optical axis 53*bm* is parallel to a direction in which a light beam having a maximum luminance among light emitted from the LED 53 is directed. In this embodiment, the optical axis 53*bm* is perpendicular to the main surface 53S of the LED 53 (about 89 degrees to about degrees).

The case 91 accommodates a plurality of LEDs 53 and a substrate 54 inside thereof. The case 91 is attached so as to be embedded in the left side face portion 2L (the right side face portion 2R and the upper face portion 2U as well) of the storage chamber 2.

The cover member 92 covers the opening of the case 91. The cover member 92 blocks the LED 53, the substrate 54, the polarizing lens member 93 and the reflecting member 94 from the outside of the case 91. The cover member 92 has transparency to at least visible light among the light emitted from the LED 53. The cover member 92 may be manufactured using a resin such as polycarbonate (PC) or polymethyl methacrylate resin (PMMA).

The cover member 92 has a first cover portion 921 (an example of a first diffusion portion) and a second cover portion 922 (an example of a second diffusion portion) which is arranged side by side with the first cover portion 921. The first cover portion 921 and the second cover portion 922 extend along one direction, respectively. A plurality of first cover portions 921 and a plurality of second cover portions 922 may be provided. As shown in FIG. 12, the second cover portions 922 and the first cover portions 921 may be integrally formed. The second cover portions 922 and the first cover portions 921 are alternately arranged in the forward and backward direction.

In the illumination unit 90 shown in FIG. 12, the first cover portion 921 extending in the up and down direction and having a linear shape and the second cover portion 922 extending in the up and down direction and having a linear shape are alternately arranged in parallel in the forward and backward direction.

A degree of light diffusion of the first cover portion 921 is lower than that of the second cover portion 922. The first cover portion 921 may be provided so as not to substantially cause diffusion of light.

A degree of light diffusion of the second cover portion 922 is higher than that of the first cover portion 921. That is, in the fifth embodiment, when the degree of light diffusion of the first cover portion 921 is C1 and the degree of light diffusion of the second cover portion 922 is C2, the relationship $C2>C1\geq 0$ is satisfied.

The cross section of the second cover portion 922 may be formed to have a predetermined angle θc with respect to the vertical axis S. In the fifth embodiment, the cross section of the second cover portion 922 is provided so that the angle θc is about 45 degrees with respect to the vertical axis S. The cross section of the second cover portion 922 may have an angle θc within a range of 20 degrees to 60 degrees with respect to the vertical axis S.

As shown in FIG. 12, the first cover portion 921 and the second cover portion 922 may not be integrally formed, but may be formed separately. If the first cover portion 921 and the second cover portion 922 are formed separately, the first cover portion 921 and the second cover portion 922 may be positioned side by side in the left and right direction. The second cover portion 922 may be disposed on one of the left side L or the right side R of the first cover portion 921 or may be disposed on both the left side L and the right side R of the first cover portion 921 in the left and right direction.

The polarizing lens member 93 is positioned so as to face the LED 53 at the inner side (B) of the LED 53. The polarizing lens member 93 is opposed to a half of the storage chamber 2 (right side (R) in the embodiment of FIG. 12) with respect to the optical axis 53*bm* of the LED 53. On the other hand, the polarizing lens member 93 is not positioned in the other half of the storage chamber 2 (left side (L) in the embodiment of FIG. 12) with respect to the optical axis 53*bm* of the LED 53.

The polarizing lens member 93 has transparency to transmit at least visible light among the light emitted from the LED 53. The polarizing lens member 93 includes a first lens portion 931 and a second lens portion 932. The polarizing lens member 93 controls the light directed toward the inside of the storage chamber 2 among the light emitted from the LED 53 to proceed to the opposite direction inside the storage chamber 2 with respect to the optical axis 53*bm* of the LED 53. The first lens portion 931 is a portion extending in a direction parallel to the optical axis 53*bm* of the LED 53. The end surface 931*f* of the first lens portion 931 facing the front side (F) and the end surface 931*b* of the first lens portion 931 facing the inner side (B) are perpendicular to the optical axis 53*bm*, respectively. The first lens portion 931 allows the light emitted from the LED 53 to proceed along the optical axis 53*bm* to the inner side (B).

The second lens portion 932 polarizes light proceeding directly toward the inside of the storage chamber 2 than the optical axis 53*bm* of the LED 53 among the light emitted from the LED 53 by total reflection. The second lens portion 932 allows light emitted from the LED 53 to proceed toward the reflecting member 94.

The polarizing lens member 93 is not located in the half area of the left side (L) with respect to the optical axis 53*bm* of the LED 53. Therefore, the polarizing lens member 93 allows the light traveling toward the reflecting member 94 side than the optical axis 53*bm* of the LED 53 among the light emitted by the LED 53 to proceed toward the reflecting member 94.

The reflecting member 94 has a reflecting surface that reflects the light of the LED 53. The reflecting member 94 according to the fifth embodiment has a curved surface concaved toward the storage chamber 2. The reflecting member 94 is provided so as to face the cover member 92. The reflecting member 94 reflects the light emitted from the LED 53 toward the inside of the storage chamber 2.

The reflecting member 94 according to the fifth embodiment has two areas. Specifically, the reflecting member 94 has a first reflecting area 941, which is a reflecting surface formed at the inner side (B), and a second reflecting area 942, which is a reflecting surface formed at the front side (F).

The angle θ1 formed by the first reflecting area 941 with respect to the optical axis 53*bm* is larger than the angle θ2 formed by the second reflecting area 942 with respect to the optical axis 53*bm* (θ1>θ2). The angle of the reflecting surface of the reflecting member 94 may be set such that the angle with respect to the optical axis 53*bm* gradually increases as the distance from the LED 53 increases.

The reflecting surface of the reflecting member 94 is not limited to a curved surface, and may be formed by joining a plurality of flat surfaces.

The polarizing lens member 93 and the reflecting member 94 allow the light emitted from the LED 53 to proceed toward the inner side (B) toward the cover member 92 at a predetermined angle. In the fifth embodiment, the polarizing lens member 93 and the reflecting member 94 allow the light from the LED 53 to proceed toward the inner side (B) at about 45 degrees with respect to the vertical axis S. The polarizing lens member 93 and the reflecting member 94 allow the light from the LED 53 to proceed toward the inner side (B) within a range of 20 degrees to 60 degrees with respect to the vertical axis S.

Figure 13:
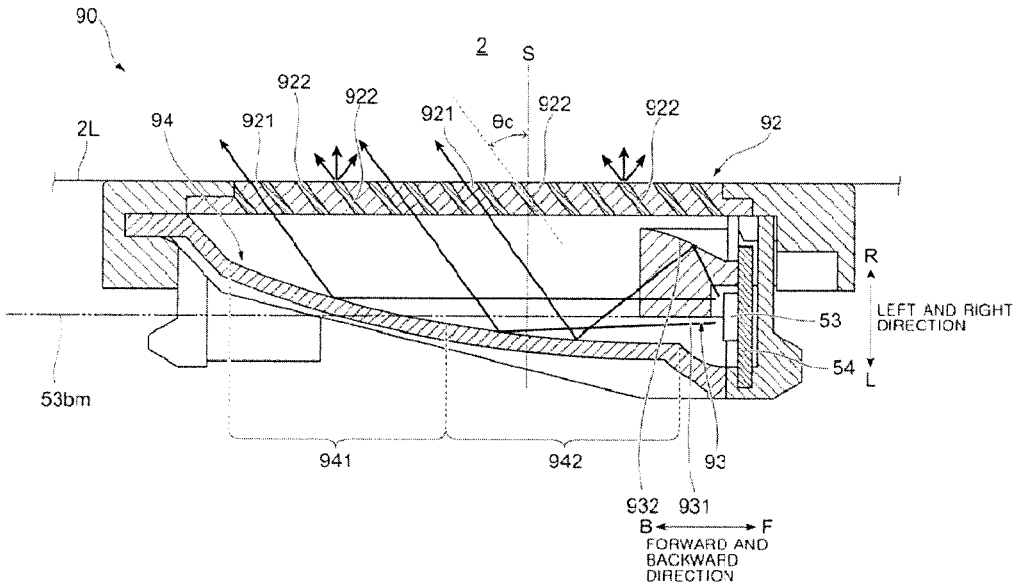
FIG. 13 is a view illustrating an illumination unit according to the fifth embodiment.

FIG. 13 is a view illustrating an illumination unit according to the fifth embodiment.

As shown in FIG. 13, the light emitted from the LED 53 along the optical axis 53*bm* is incident on the first lens portion 931 of the polarizing lens member 93. The light travels along the optical axis 53*bm* and exits from the first lens portion 931. Thereafter, the light is reflected by the first reflecting area 941 and travels toward the cover member 92.

Light passing through the first lens portion 931 is incident on the reflecting member 94 at a small angle. The light incident on the reflecting member 94 at a small angle is reflected by the first reflecting area 941 having a relatively large angle with respect to the optical axis 53*bm*. The light reflected from the first reflecting area 941 travels toward the cover member 92 at a predetermined angle (about 45 degrees in the fifth embodiment) with respect to the vertical axis S.

The light incident on the second lens portion 932 from the LED 53 is totally-reflected by the second lens portion 932. The light reflected by the second lens portion 932 travels toward the second reflecting area 942. The light reflected from the second reflecting area 942 travels toward the cover member 92.

The light reflected by the second lens portion 932 travels at a large angle with respect to the reflecting member 94. The light traveling at a large angle with respect to the reflecting member 94 is reflected by the second reflecting area 942 having a relatively small angle with respect to the optical axis 53*bm*. The light reflected by the second reflecting area 942 travels toward the cover member 92 at a predetermined angle (about 45 degrees in the fifth embodiment) with respect to the vertical axis S.

The light emitted from the LED 53 and directed to the opposite side of the storage chamber 2 than the optical axis 53*bm* (left side (L) in the embodiment of FIG. 12) proceeds directly to the reflecting member 94. And the light that has traveled directly to the reflecting member 94 is reflected by the reflecting member 94. The light reflected by the reflecting member 94 travels toward the cover member 92 at a predetermined angle (about 45 degrees in the fifth embodiment) with respect to the vertical axis S.

In the illumination unit 90 according to the fifth embodiment, the angle of the reflecting surface of the reflecting member 94 that reflects the light emitted from the LED 53 is greater at the inner side (B) than at the front side (F). Therefore, the illumination unit 90 according to the fifth embodiment can realize both surface emission and uniform emission.

As described above, the light reflected by the reflecting member 94 travels toward the cover member 92 at a predetermined angle (about 45 degrees in the fifth embodiment) with respect to the vertical axis S. As shown in FIG. 13, the first cover portion 921 forms a predetermined angle θc (about 45 degrees in the fifth embodiment) with respect to the vertical axis S. Therefore, the light incident on the cover member 92 at a predetermined angle (about 45 degrees in the fifth embodiment) with respect to the vertical axis S passes through the first cover portion 921. Light entering the cover member 92 at an angle different from the predetermined angle with respect to the vertical axis S is incident on the second cover portion 922 and scattered.

The illumination unit 90 according to the fifth embodiment irradiates relatively strong light toward the inner side (B) of the storage chamber 2 and irradiates a weak diffused light toward the front side (F) to polarize the optical axis Bm toward the inner side (B). As described above, the illumination unit 90 according to the fifth embodiment directs the light from the LED 53 to the inner side (B) of the storage chamber 2, and prevents the light from the LED 53 from proceeding toward the front side (F).

In the illumination unit 90 according to the fifth embodiment, the polarizing lens member 93 is not positioned on the opposite side of the storage chamber 2 with respect to the optical axis 53*bm* of the LED 53 so that the light directly travels from the LED 53 toward the reflecting member 94. Accordingly, the size of the polarizing lens member 93 can be reduced. And, the size of the illumination unit 90 is reduced. In addition, the illumination unit 90 according to the fifth embodiment reduces the loss due to Fresnel reflection, which may be caused by the transmission of light through the polarizing lens member 93, so that the luminous efficiency is high.

In the illumination unit 90 according to the fifth embodiment, the polarizing lens member 93 is disposed on the storage chamber 2 side than the optical axis 53*bm* of the LED 53. By the polarized light distribution by the polarizing lens member 93, the light directly traveling from the LED 53 to the cover member 92 is reduced. Therefore, non-uniform light emission in the vicinity of the LED 53 is prevented.

Figure 14:
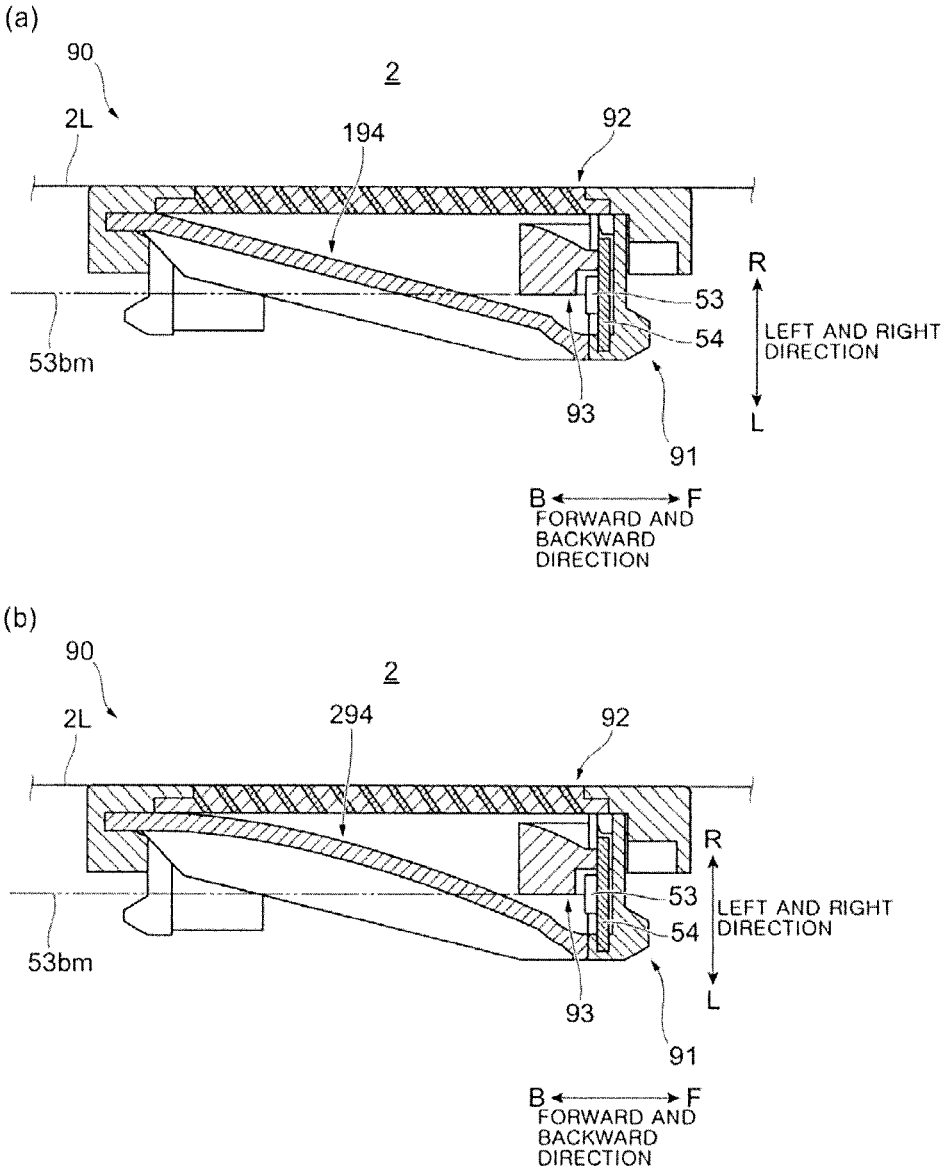
FIGS. 14A and 14B are views illustrating illumination units according to a first alternative embodiment and a second alternative embodiment.

FIGS. 14A and 14B are views illustrating illumination units according to a first alternative embodiment and a second alternative embodiment.

FIG. 14A illustrates a cross-sectional view of the illumination unit 90 of the first alternative embodiment, and FIG.

14B illustrates a cross-sectional view of the illumination unit 90 of the second alternative embodiment.

As shown in FIG. 14A, the shape of the reflecting member 194 of the illumination unit 90 according to the first alternative embodiment is different from that of the reflecting member 94 of the above-described fifth embodiment. Hereinafter, the reflecting member 194 will be described.

The shape of the reflecting surface of the reflecting member 194 is formed in a planar shape. That is, the cross-section of the reflecting member 194 is formed in a straight line. The angle of the reflecting surface of the reflecting member 194 with respect to the optical axis 53*bm* is constant in the forward and backward direction. The reflecting member 194 reflects the light from the LED 53 toward the storage chamber 2.

The illumination unit 90 according to the first alternative embodiment directs the light from the LED 53 to the inner side (B) of the storage chamber 2, and prevents the light from the LED 53 from proceeding toward the front side (F).

As shown in FIG. 14B, the shape of the reflecting member 294 of the illumination unit 90 according to the second alternative embodiment is different from that of the reflecting member 94 of the above-described fifth embodiment. Hereinafter, the reflecting member 294 will be described.

The shape of the reflecting surface of the reflecting member 294 is formed in a convex curved shape toward the storage chamber 2. The angle formed by the reflecting member 294 with respect to the optical axis 53*bm* in the front side (F) is larger than that in the inner side (B). The reflecting member 294 reflects the light from the LED 53 toward the storage chamber 2.

The illumination unit 90 according to the second alternative embodiment directs the light from the LED 53 to the inner side (B) of the storage chamber 2, and prevents the light from the LED 53 from proceeding toward the front side (F).

In the second alternative embodiment, the reflecting surface of the reflecting member 294 is not limited to a curved surface, but may be formed by joining a plurality of flat surfaces.

Figure 15:
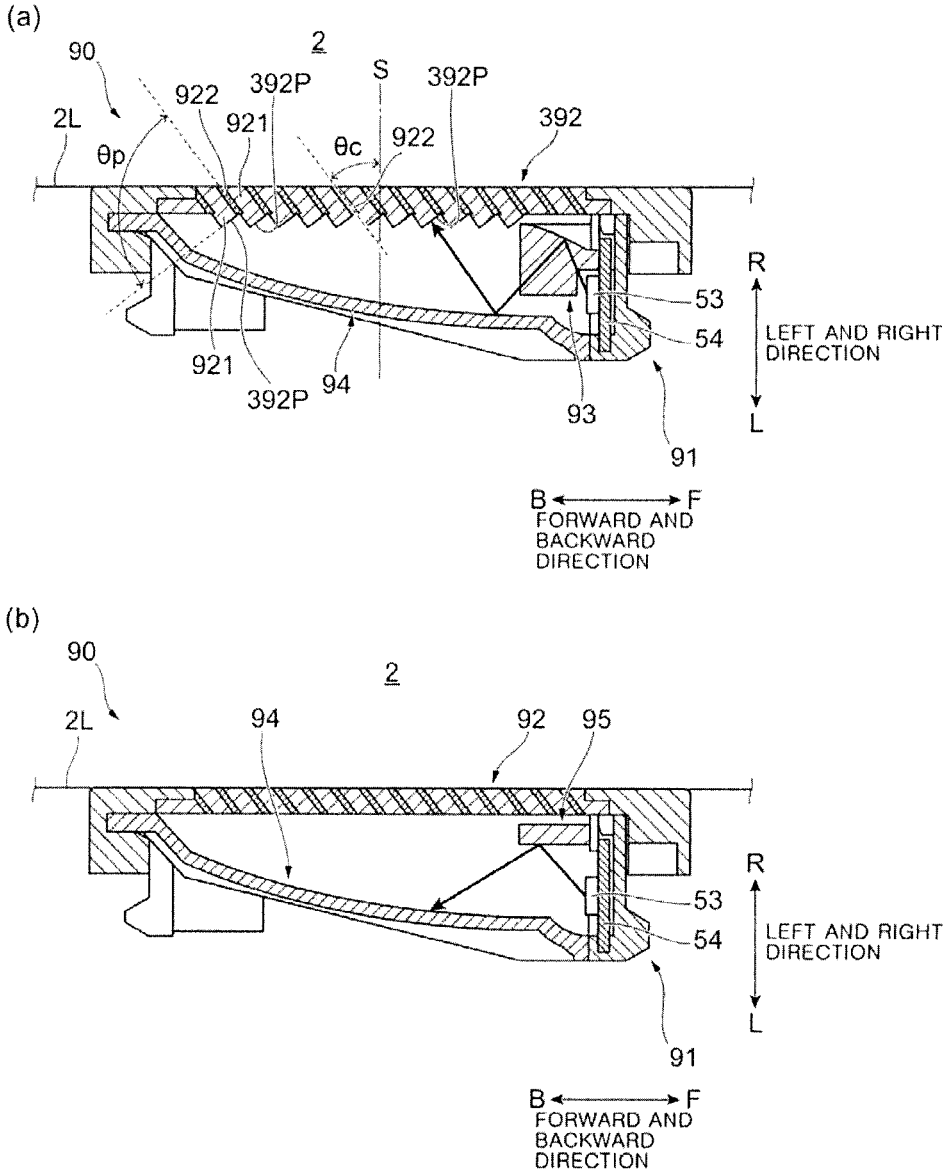
FIGS. 15A and 15B are views illustrating illumination units according to a third alternative embodiment and a fourth alternative embodiment.

FIGS. 15A and 15B are views illustrating illumination units according to a third alternative embodiment and a fourth alternative embodiment.

FIG. 15A illustrates a cross-sectional view of the illumination unit 90 of the third alternative embodiment, and FIG. 15B illustrates a cross-sectional view of the illumination unit 90 of the fourth alternative embodiment.

As shown in FIG. 15A, the shape of the cover member 392 of the illumination unit 90 according to the third alternative embodiment is different from that of the cover member 92 of the above-described fifth embodiment. Hereinafter, the cover member 392 will be described.

The cover member 392 may be prism cut on a light incident surface thereof which faces the reflection member 94. Specifically, each first cover portion 921 may be formed with a V-shaped convex portion 392P. Each of the convex portions 392P forms a surface perpendicular to the second cover portion 922 having a predetermined angle with respect to the vertical axis S (about 89 degrees to 91 degrees). Therefore, the light reflected by the reflecting member 94 may be incident on the first cover portion 921 in a direction perpendicular to the first cover portion 921.

The illumination unit 90 according to the third alternative embodiment can reduce the loss due to Fresnel reflection that may occur when the light reflected by the reflecting member 94 is incident on the cover member 392.

As shown in FIG. 15B, the illumination unit 90 according to the fourth alternative embodiment includes a second reflecting member 95 in place of the polarizing lens member 93 described above.

The second reflecting member 95 may be positioned in front of the LED 53. The second reflecting member 95 is provided on the storage chamber 2 side (the right side R in the embodiment of FIGS. 15A and 15B) with respect to the LED 53. The second reflecting member 95 allows the light which is subject to travel toward the inside of the storage chamber 2 among light emitted from the LED 53 to be incident on the reflecting member 94.

The illumination unit 90 according to the fourth alternative embodiment directs the light from the LED 53 to the inner side (B) of the storage chamber 2, and prevents the light from the LED 53 from proceeding toward the front side (F).

The entire interior of the storage chamber 2 can be brighter by the illumination unit 90 according to the fifth embodiment. By the illumination unit 90, glare is reduced and a user can find the article 100 in the storage chamber 2 more easily.

In the above, the illumination unit 90 according to the fifth embodiment includes a plurality of LEDs 53 arranged in parallel in the up and down direction and controls the light emitted from the LEDs 53. However, the illumination unit 90 according to the fifth embodiment is not limited to above structure. For example, as in the first embodiment, a plurality of LEDs 53 may be arranged in the forward and backward direction. That is, using the cover member 92 (cover member 392), the polarizing lens member 93, the reflecting member 94 (the reflecting member 194, the reflecting member 294), and the second reflecting member 95, the light of the LED 53 may be controlled.

Hereinafter, the refrigerator 1 according to a sixth embodiment will be described. In the sixth embodiment, components similar to those of the other embodiments are denoted by the same reference numerals, and detailed description thereof is omitted.

Figure 16:
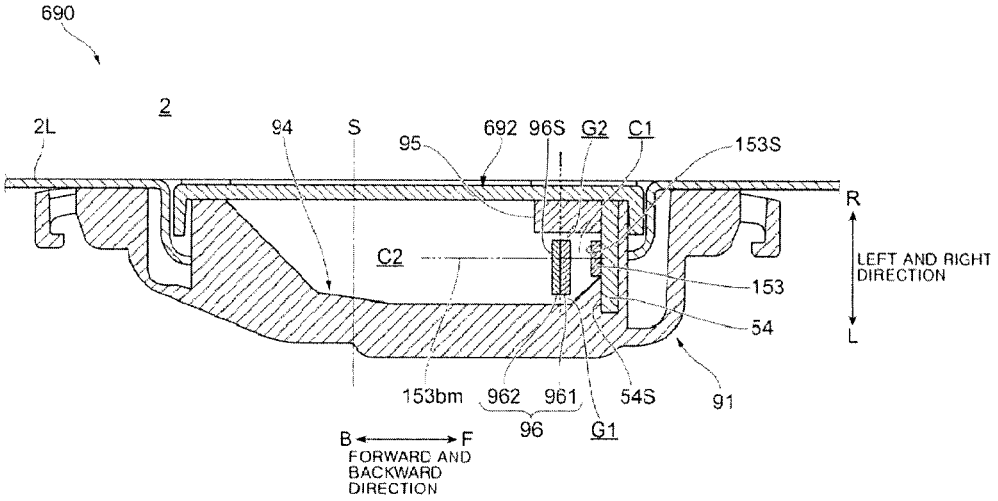
FIG. 16 is a view illustrating an illumination unit according to the sixth embodiment.

FIG. 16 is a view illustrating an illumination unit according to the sixth embodiment.

FIG. 16 is a cross-sectional view of an illumination unit 690 taken along the forward and backward direction and the left and right direction and viewed from the up and down direction.

The refrigerator 1 according to the sixth embodiment has an illumination unit 690 instead of the illumination unit 90 (see FIG. 12) according to fifth embodiment. Hereinafter, the illumination unit 690 will be described in detail.

As shown in FIG. 16, the illumination unit 690 includes an LED chip 153 that emits light by electric current, a substrate 54, and a case 91. The illumination unit 690 includes a cover member 692 for covering the case and a wavelength converting member 96 (an example of a wavelength converting unit) provided opposite to the LED chip 153. And the illumination unit 690 includes a reflecting member 94 (an example of an optical unit) and a second reflecting member 95 (an example of an optical unit).

The LED chip 153 is a semiconductor chip that emits blue light. In the sixth embodiment, the LED chip 153 is mounted by wire bonding (not shown) and is electrically connected to the substrate 54.

In the sixth embodiment, the LED chip 153 and the substrate 54 are provided such that their respective major surfaces 153S and 154S are parallel to the vertical axis S. The optical axis 153*bm* of the LED chip 153 is the forward and backward direction of the left side surface portion 2L (the right side surface portion 2R and the upper surface portion 2U as well) of the storage chamber 2.

The cover member 692 is installed so as to cover the opening of the case 91. The cover member 92 blocks the LED chip 153, the substrate 54, the reflecting member 94, the second reflecting member 95 and the wavelength converting member 96 from the outside of the case 91. The cover member 692 has transparency to at least visible light among the light emitted from the LED chip 153 or the wavelength converting member 96.

The cover member 692 may be manufactured using a resin such as polycarbonate (PC) or polymethyl methacrylate resin (PMMA).

The wavelength converting member 96 is a transparent resin coated with a fluorescent material that absorbs light emitted from the LED chip 153 and emits light having a long wavelength. Specifically, the wavelength converting member 96 includes a green fluorescent portion 961 that absorbs blue light and emits green light. The wavelength converting member 96 has a red fluorescent portion 962 that absorbs blue light and emits red light. The green fluorescent portion 961 and the red fluorescent portion 962 are each formed in a plate shape. The green fluorescent portion 961 and the red fluorescent portion 962 are fixed in close contact with each other.

The wavelength converting member 96 may be formed by a transparent resin member coated on both opposite sides thereof with a fluorescent material that absorbs blue light and emits green light and a fluorescent material that absorbs blue light and emits red light respectively. The combination of a wavelength emitted from the light source and a wavelength emitted from the fluorescent material is not limited to above embodiment, but may be other combinations.

The wavelength converting member 96 is fixed in position by a support member (not shown). The wavelength converting member 96 is arranged such that the major surface 96S of the wavelength converting member 96 is parallel to the vertical axis S. That is, the major surface 96S of the wavelength converting member 96 is disposed in parallel with the major surface 153S of the LED chip 153. The wavelength converting member 96 is spaced apart from the LED chip 153 by a predetermined interval.

A first gap G1 (an example of a non-passing through portion) is formed between the wavelength converting member 96 and the reflecting member 94 in a direction of the major surface 96S (the left and right direction in this embodiment). And a second gap G2 (an example of a non-passing through portion) is formed between the wavelength converting member 96 and the second reflecting member 95 in the direction of the major surface 96S (the left and right direction in this embodiment). That is, the first gap G1 or the second gap G2 is formed between the wavelength converting member 96 and structures adjacent to the wavelength converting member 96. The light emitted from the LED chip 153 is able to pass through the first gap G1 and the second gap G2.

In the sixth embodiment, the wavelength converting member 96 mainly divides the space formed by the reflecting member 94 and the cover member 692 into two. A first space C1 (an example of the first space portion) is formed between the wavelength converting member 96 and the LED chip 153. A second space C2 (an example of the second space portion) is formed on a side opposite to the LED chip 153 with respect to the wavelength converting member 96. That is, the second space C2 is formed at a position opposite to the first space C1 with respect to the wavelength converting member 96.

Specifically, the first space C1 is a space surrounded by the wavelength converting member 96, the reflecting member 94, the second reflecting member 95, the LED chip 153, and the substrate 54. The second space C2 is a space surrounded by the wavelength converting member 96, the reflecting member 94, and the cover member 692.

In the sixth embodiment, a boundary between the first space C1 and the second space C2 is formed by the wavelength converting member 96. The boundary between the first space C1 and the second space C2 is formed by a straight imaginary line I connecting the wavelength converting member 96 and the reflecting member 94 at the shortest distance. The boundary is formed by a straight imaginary line I connecting the wavelength converting member (96) and the second reflecting member (95) at the shortest distance.

As shown in FIG. 16, the cross-sectional area of the first space C1 is smaller than the cross-sectional area of the second space C2. That is, the volume of the first space C1 is smaller than the volume of the second space C2.

The cross-sectional area of the first space C1 mainly depends on a length in the left and right direction of the cross-section (the plane along the forward and backward direction and the left and right direction) of the wavelength converting member 96. The cross-sectional area of the second space C2 mainly depends on a length in the forward and backward direction of the cross-section of the cover member 692. Therefore, in the sixth embodiment, the length of the wavelength converting member 96 in the left and right direction is shorter than the length of the cover member 692 in the forward and backward direction.

Figure 17:
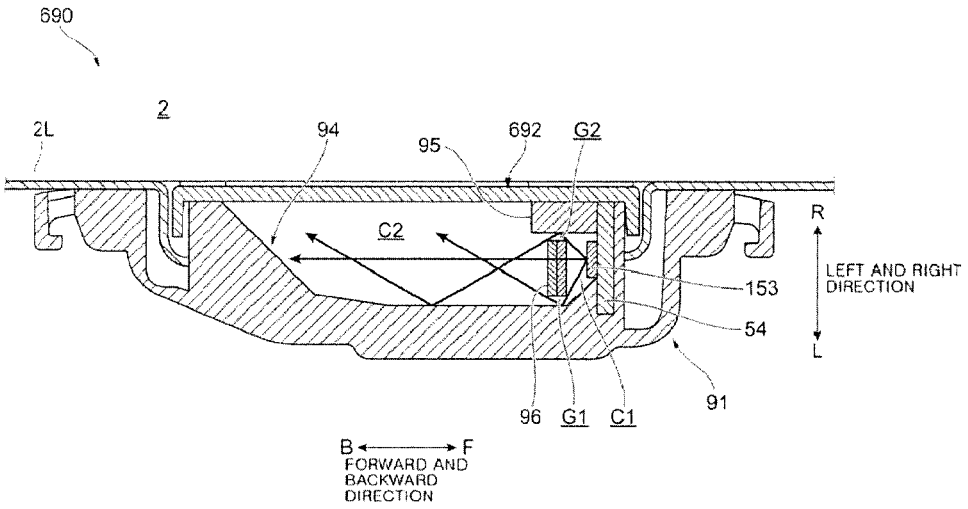
FIG. 17 is a view for explaining the illumination unit according to the sixth embodiment.

FIG. 17 is a view for explaining the illumination unit according to the sixth embodiment.

As shown in FIG. 17, the light emitted from the LED chip 153 passes through the first space C1 and is incident on the wavelength converting member 96. The blue light emitted from the LED chip 153 is converted into a red light or a green light by the wavelength converting member 96. Further, the red light and the green light reach the second space C2 formed on the inner side (B) of the wavelength converting member 96.

Among the light emitted from the LED chip 153, light directed toward the first gap G1 travels toward the reflecting member 94 without passing through the wavelength converting member 96. That is, the blue light passing through the first gap G1 is reflected by the reflecting member 94 while the wavelength is not changed by the wavelength converting member 96. The blue light passing through the first gap G1 reaches the second space C2.

And among the light emitted from the LED chip 153, light directed toward the second gap G2 travels toward the second reflecting member 95 without passing through the wavelength converting member 96. That is, the blue light passing through the second gap G2 is reflected by the second reflecting member 95 while the wavelength is not changed by the wavelength converting member 96. The blue light passing through the second gap G2 reaches the second space C2.

In the second space C2, red light or green light that has passed through the wavelength converting member 96 is mixed with blue light that does not pass through the wavelength converting member 96 to become white light. Thereafter, as described with reference to the fifth embodiment, these lights are reflected by the reflecting member 94 or the like, and pass through the cover member 692 and proceed toward the inner side (B) of the storage chamber 2.

The entire interior of the storage chamber 2 can be brighter by the illumination unit 690 according to the sixth embodiment. By the illumination unit 690, glare is reduced and a user can find the article 100 in the storage chamber 2 more easily.

In the illumination unit 690, since the second space C2 is larger than the first space C1, a sufficient volume is ensured for mixing the red light, the green light, and the blue light. On the other hand, since the first space C1 is small, the wavelength converting member 96 is disposed in the vicinity of the LED chip 153. As a result, the size of the wavelength converting member 96 is reduced. That is, the LED chip 153 emits light radially. By disposing the wavelength converting member 96 close to the LED chip 153, the size of the wavelength converting member 96 may be small. That is, the size of the illumination unit 690 can be reduced.

In the illumination unit 690 according to the sixth embodiment, deterioration of the optical efficiency is suppressed. When the blue light from the LED chip 153 is passed through a transparent member in which a fluorescent material is dispersed, the blue light is extracted as light not converted into the green light or the red light by the fluorescent material. However, since blue light passes through the transparent member, loss of light energy such as Fresnel loss may occur.

In contrast, in the illumination unit 690 according to the sixth embodiment, the blue light reaches the second space C2 without passing through the transparent member in which the fluorescent material such as the wavelength converting member 96 is dispersed. Therefore, the blue light that has arrived at the second space C2 without passing through the wavelength converting member 96 does not suffer loss of light energy such as fresnel loss. Therefore, in the illumination unit 690, deterioration of the optical efficiency is suppressed. As a result, for example, brightness perception in the storage chamber 2 is improved.

In the illumination unit 690, the color temperature may be adjusted by changing the size of the first gap G1 or the second gap G2. For example, by reducing the interval of the first gap G1 or the second gap G2, the blue light decreases and the color temperature decreases. On the other hand, by increasing the interval of the first gap G1 or the second gap G2, the blue light increases and the color temperature increases. As described above, in the illumination unit 690 according to the sixth embodiment, the color temperature of the illumination unit 690 is easily adjusted by changing the size of the wavelength converting member 96.

The configuration of the wavelength converting member 69 is not limited to the above described example. As the wavelength converting member 96, a ceramic plate material such as glass coated with a fluorescent material may be used. The shape of the wavelength converting member 96 is not limited to the above described example. The wavelength converting member 96 may have a convex shape of an arc, or an uneven shape irregular in thickness.

Some configurations of the illumination unit 690 according to the sixth embodiment may be applied to other embodiments.

For example, in another embodiment, when the LED chip emitting monochromatic light is used, the wavelength converting member 96 may be disposed on the LED chip side. The wavelength converting member 96 is separated from the LED chip by a predetermined distance to form a first space. Further, a second space with a cross-sectional area larger than that of the first space is formed on the side opposite to the LED chip with respect to the wavelength converting member 96. The wavelength converting member 96 may not allow all of the light from the LED chip to pass therethrough and may be configured so that a part of the light from the LED chip does not pass through the wavelength converting member 96.

Hereinafter, the refrigerator 1 according to the seventh embodiment will be described. In the seventh embodiment, components similar to those of the other embodiments are denoted by the same reference numerals, and detailed description thereof is omitted.

Figure 18:
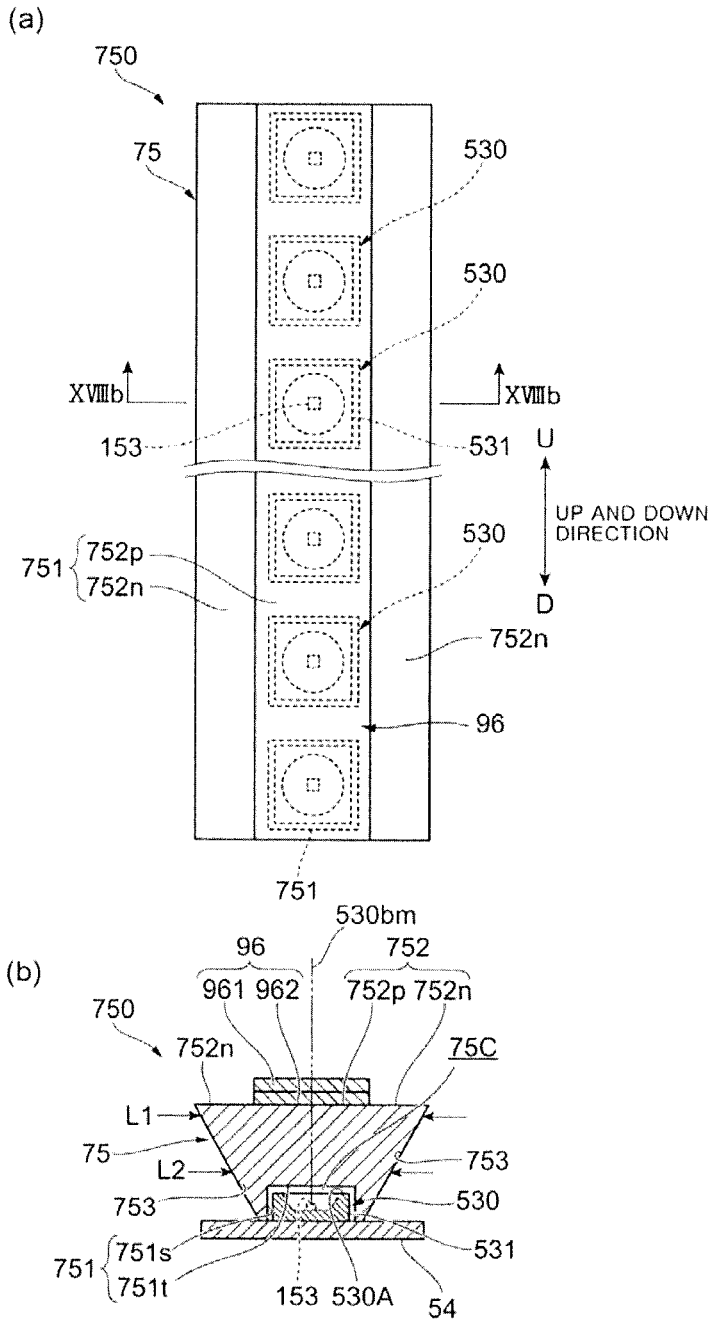
FIGS. 18A and 18B are views illustrating an illumination unit according to the seventh embodiment.

FIGS. 18A and 18 B are views illustrating an illumination unit according to the seventh embodiment.

FIG. 18A is a front view of the illumination unit 750. FIG. 18B is a cross-sectional view of the illumination unit 750 shown in FIG. 18A taken along the line XVIIIb-XVIIIb.

The refrigerator 1 of the seventh embodiment has an illumination unit 750 instead of the illumination unit 50 (see FIG. 6) of the second embodiment. Hereinafter, the illumination unit 750 will be described in detail.

As shown in FIGS. 18A and 18B, the illumination unit 750 includes an LED package 530 that emits light, a substrate 54, a lens member 75 (an example of a transparent unit) which is opposed to the LED package 530, and a wavelength converting member 96 (an example of a wavelength converting unit).

As shown in FIG. 18A, the illumination unit 750 is formed to extend in one direction (the up and down direction). In detail, the illumination unit 750 is extended along the up and down direction at the left side surface portion 2L and the right side surface portion 2R (see FIG. 6).

The LED package 530 is a packaged light source accommodating the LED chip 153 (an example of a light emitting element) in a container 531 having a concave cross section. Although not shown, the container 531 is provided with a lead frame electrically connected to the LED chip 153. Through the lead frame, the LED chip 153 and the substrate 54 are electrically connected. The concave portion of the container 531 is filled with a transparent sealing resin, and the LED chip 153 is sealed. In the LED package 530, the sealing resin is not filled with the fluorescent material.

The LED package 530 is provided such that an angle formed by the optical axis 530*bm* (a direction along light having a maximum luminance in the single LED package 530) and the vertical axis S (see FIG. 6) is in the range of 20 degrees to 60 degrees. That is, the optical axis 530*bm* is set to face the inner side B in the forward and backward direction. In this embodiment, the optical axis 530*bm* is provided perpendicular to an end surface 530A of the LED package 530.

The lens member 75, as shown in FIG. 18A, is provided in a shape extended in one direction. The lens member 75 is provided as a single member with respect to the plurality of LED packages 530. The lens member 75 transmits light incident from the LED package 530. That is, the lens member 75 collectively controls the light distribution of the light emitted from the plurality of LED packages 530. The lens member 75 of the present embodiment does not include a fluorescent material.

The lens member 75 is fixed to the substrate 54 as shown in FIG. 18B.

The lens member 75 is configured to direct the light from the LED package 530 toward the inner side B of the storage chamber 2 and to control the light distribution to prevent the light from the LED package 530 from traveling toward the front side F (see FIG. 6).

The lens member 75 may be manufactured using a resin such as polycarbonate (PC) or polymethyl methacrylate resin (PMMA), glass, or the like.

As shown in FIG. 18B, the lens member 75 is formed in a trapezoidal shape in cross section. The lens member 75 has a lower end portion 751 formed on the LED package 530 side. The lens member 75 has an upper end portion 752 provided on a side opposite to a side facing to the LED package 530. And the lens member 75 has a side portion 753 (an example of an inclined portion) formed on a side surface thereof.

The lower end portion 751 has a concave portion. The lower end portion 751 accommodates the LED package 530 inside thereof. And light emitted from the LED package 530 is incident into the lens member 75 through the lower end portion 751.

The lower end portion 751 has a first surface 751*t* facing the end surface 530A of the LED package 530 and a second surface 751*s* facing the side surface of the LED package 530. The first surface 751 *t* is provided in parallel to the end surface 530 A of the LED package 530. That is, the first surface 751*t* is formed to be perpendicular to the optical axis 530*bm*.

In the seventh embodiment, the first surface 751*t* and the second surface 751*s* are provided so as to have a predetermined gap with respect to the LED package 530. That is, a space 75C including a gas such as air is formed between the lower end portion 751 and the LED package 530.

The upper end portion 752 forms a portion where the light incident on the lens member 75 comes out of the lens member 75. In the seventh embodiment, the upper end portion 752 is formed parallel to the end surface 530A of the LED package 530, as shown in FIG. 18B. That is, the upper end portion 752 is formed to be perpendicular to the optical axis 530*bm*.

The upper end portion 752 has an opposing surface 752*p* opposed to the wavelength converting member 96 and an output surface 752*n* (an example of the output unit) not opposed to the wavelength converting member 96. The opposing surface 752*p* is formed to extend in one direction (the up and down direction) corresponding to the wavelength converting member 96, as shown in FIG. 18A. The wavelength converting member 96 is fixed to the opposing surface 752*p* by adhesion or the like. Output surfaces 752*n* are formed on both sides of the opposing surface 752*p*. The output surface 752*n* is formed adjacent to the opposing surface 752*p*. The two output surfaces 752*n* extend in one direction (the up and down direction). The output surface 752*n* bypasses the wavelength converting member 96 to form a path through which light travels to the outside of the lens member 75.

In the first embodiment, the ratio of an area of the output face 752*n* to an area of the upper end portion 752 is set to 15%. This ratio is preferably 2% or more and 35% or less. More preferably, the ratio may be 5% or more and 30% or less.

By changing the area of the output surface 752*n*, the color temperature of the light emitted by the illumination unit 750 may be adjusted. For example, as the area of the output surface 752*n* increases, the color temperature of the light of the illumination unit 750 increases. As the area of the output surface 752*n* decreases, the color temperature of the light of the illumination unit 750 decreases.

The side portions 753 are formed on both sides with respect to the optical axis 530*bm* of the LED package 530, as shown in FIG. 188. Further, the side portion 753 is formed so as to be wider as it is away from the LED package 530. In the seventh embodiment, the width L 1 of the side portion 753 farther from the LED package 530 is larger than the width L 2 of the side closer to the LED package 530. That is, the side portion 753 is formed at an oblique angle with respect to the optical axis 530*bm* at a predetermined angle.

The side portion 753 totally-reflects the light emitted from the LED package 530. The side portion 753 serves as a reflecting surface for reflecting the light from the LED package 530 toward the upper end portion 752.

Figure 19:
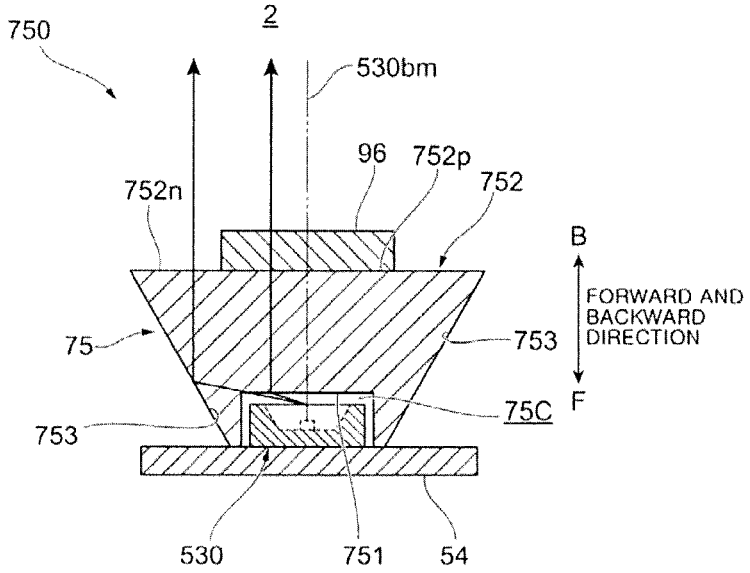
FIG. 19 is a view for explaining the illumination unit according to the seventh embodiment.

FIG. 19 is a view for explaining the illumination unit according to the seventh embodiment.

As shown in FIG. 19, the blue light emitted radially from the LED package 530 passes through the space 75C and enters the lens member 75 from the lower end portion 751. The blue light is incident on the lens member 75 having a higher density than the space 75C from the space 75C, and is refracted toward the optical axis 530*bm*. Also, the blue light traveling from the LED package 530 to the side portion 753 is reflected at the side portion 753. The blue light from the LED package 530 mainly travels along the optical axis 530*bm*.

And a part of the blue light emitted from the LED package 530 is directed the opposing surface 752*p*. Thereafter, this blue light passes through the wavelength converting member 96. The blue light is converted into red light or green light by the wavelength converting member 96. The red light and the green light are emitted from the lens member 75 and the wavelength converting member 96.

The light directed toward the output surface 752*n* of the blue light emitted from the LED package 530 does not pass through the wavelength converting member 96 but comes out of the lens member 75.

As described above, red light, green light, and blue light are emitted from the illumination unit 750. These three color lights are mixed in the storage chamber 2. As a result, the storage unit 2 is illuminated in white by the illumination unit 750. As described above, light is emitted from the illumination unit 750 toward the inner side B (see FIG. 6) of the storage chamber 2. The light emitted from the LED package 530 toward the front side (F) (see FIG. 6) is reflected by the side portion 753 of the lens member 75. Therefore, light is prevented from advancing toward the front side of the storage chamber 2 from the illumination unit 750.

The entire interior of the storage chamber 2 can be brighter by the illumination unit 750 of the seventh embodiment. And by the illumination unit 750, glare is reduced and a user can find the article 100 (see FIG. 6) in the storage chamber 2 more easily.

Fine irregularities may be formed on the output surface 752*n* to increase the degree of light diffusion of the output surface 752*n*. The light extraction efficiency from the output surface 752*n* may be increased. In this case, the degree of light diffusion of the output face 752*n* may be equal to the degree of light diffusion of the wavelength converting member 96.

The side portion 753 serves as a reflecting surface of light from the LED package 530. Therefore, it is preferable that the side portion 753 has a small degree of light diffusion. Therefore, the degree of light diffusion of the output surface 752*n* may be larger than the degree of light diffusion of the side portion 753.

In the illumination unit 750 according to the seventh embodiment, deterioration of the optical efficiency is suppressed. In case all blue light from the LED chip 153 is passed through the transparent member in which a fluorescent material is dispersed, the blue light is extracted as light not converted to green light or red light by the fluorescent material. However, since this blue light passes through the transparent member, loss of light energy such as Fresnel loss may occur.

In contrast, in the illumination unit 750 of the seventh embodiment, the blue light is output without passing through the transparent member in which the fluorescent material such as the wavelength converting member 96 is dispersed. Therefore, loss of light energy such as fresnel loss does not occur in the blue light output without passing through the wavelength converting member 96. Therefore, in the illumination unit 750, deterioration of the optical efficiency is suppressed. As a result, for example, brightness perception in the storage chamber 2 is improved.

The light emitted from the LED package 530 is narrowed toward the optical axis 530*bm* by the lens member 75 as described above. The wavelength converting member 96 is disposed at the upper end portion 752 of the lens member 75. Therefore, in the seventh embodiment, the width of the wavelength converting member 96 in the direction perpendicular to the optical axis 530*bm* can be made small. That is, the illumination unit 750 can be downsized.

In the seventh embodiment, the wavelength converting member 96 is fixed to the lens member 75. That is, the wavelength converting member 96 is supported by itself. Accordingly, it is not necessary to provide a support member for supporting the wavelength converting member 96, and the number of parts can be reduced.

The illumination unit 750 of the seventh embodiment may be arranged so as to extend from the front side F to the inner side B in the forward and backward direction as shown in FIG. 1. In this case, the direction of the lens member 75 can be set so that the light from the illumination unit 750 travels toward the inner side B of the storage chamber 2 and travelling of the light toward the front side F is suppressed. A part of the configuration of the illumination unit 750 described in the seventh embodiment may be applied to other embodiments.

Hereinafter, the refrigerator 1 according to the eighth embodiment will be described. In the eighth embodiment, components similar to those of the other embodiments are denoted by the same reference numerals, and detailed description thereof is omitted.

Figure 20:
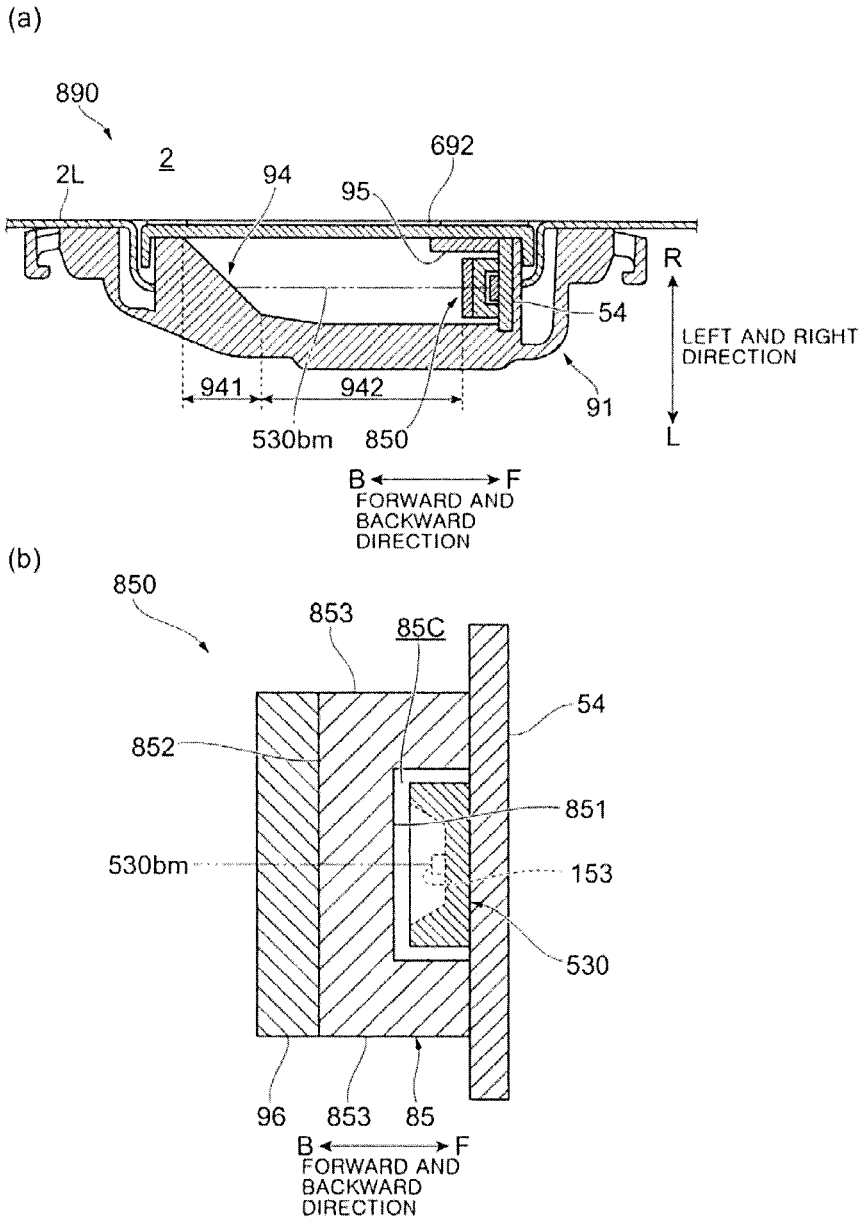
FIGS. 20A and 20B are views illustrating an illumination unit according to an eighth embodiment.

FIGS. 20A and 20B are views illustrating an illumination unit according to an eighth embodiment.

FIG. 20A shows a cross-sectional view of an illumination unit 890 taken along the forward and backward direction and the left and right direction and viewed from the up and down direction. FIG. 20B shows an overall configuration of a light emitting unit 850 provided in the illumination unit 890.

The refrigerator 1 of the eighth embodiment has an illumination unit 890 instead of the illumination unit 90 (see FIG. 12) of the fifth embodiment. Hereinafter, the illumination unit 890 will be described in detail.

As shown in FIG. 20A, the illumination unit 890 includes a light emitting unit 850 that emits light, and a case 91. The illumination unit 890 includes a cover member 692, a reflecting member 94, and a second reflecting member 95.

The illumination unit 890 is formed to extend in one direction (the up and down direction). In detail, the illumination unit 890 is extended along the up and down direction at the left side surface portion 2L and the right side surface portion 2R (see FIG. 6).

The configuration of the light emitting unit 850 is similar to the illumination unit 750 of the seventh embodiment. The light emitting unit 850 has an LED package 530 and a substrate 54, as shown in FIG. 20B. The light emitting unit 850 has a lens member 85 and a wavelength converting member 96 which are provided opposite to the LED package 530.

The lens member 85 is provided in a shape extended in one direction. The lens member 85 is provided as a single member with respect to the plurality of LED packages 530. The lens member 85 transmits light incident from the LED package 530. The lens member 85 of the present embodiment does not include a fluorescent material. The lens member 85 is fixed to the substrate 54.

The lens member 85 may be manufactured using a resin such as polycarbonate (PC) or polymethyl methacrylate resin (PMMA), glass, or the like.

As shown in FIG. 20B, the lens member 85 is formed in a rectangular shape in cross section. The lens member 85 has a lower end portion 851 provided on the LED package 530 side. The lens member 85 has an upper end portion 852 provided on a side opposite to a side facing to the LED package 530. And the lens member 85 has a side portion 853 formed on a side surface thereof.

The lower end portion 851 has the same basic structure as the lower end portion 751 of the seventh embodiment. The lower end portion 851 has a concave portion. The lower end portion 851 accommodates the LED package 530 inside thereof. And light emitted from the LED package 530 is incident into the lens member 85 through the lower end portion 851. A space 85C including a gas such as air is formed between the lower end portion 851 and the LED package 530.

The upper end portion 852 forms a portion opposed to the wavelength converting member 96. The upper end portion 852 is provided perpendicular to the optical axis 530*bm*, as shown in FIG. 20B. A width of the upper end portion 852 is formed to be equal to a width of the wavelength converting member 96. The wavelength converting member 96 is fixed to the upper end portion 852 by adhesion or the like.

The side portions 853 are formed on both sides with respect to the optical axis 530*bm* of the LED package 530, respectively. The side portions 853 are formed parallel to the optical axis 530*bm*. The wavelength converting member 96 is not provided on the side portion 853. The side portion 853 bypasses the wavelength converting member 96 and forms a path through which light travels to the outside of the lens member 85.

Figure 21:
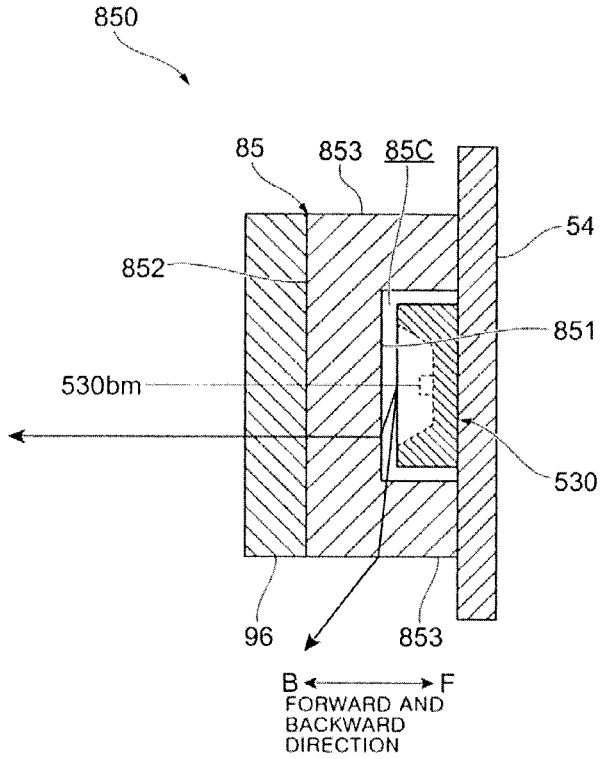
FIG. 21 is a view for explaining a light emitting unit according to the eighth embodiment.

FIG. 21 is a view for explaining a light emitting unit according to the eighth embodiment.

As shown in FIG. 21, the blue light emitted from the LED package 530 passes through the space 85C and enters the lens member 85 from the lower end portion 851. The blue light spreading in the radial direction is refracted toward the optical axis 530*bm* side when it is incident on the lens member 85 having a higher density than the space 85C from the space 85C. The blue light mainly travels along the optical axis (530 *bm*). A part of the blue light is directed to the upper end portion 852. The blue light passes through the wavelength converting member 96. The blue light is converted into red light or green light by the wavelength converting member 96. The red light and the green light come out of the lens member 85 and the wavelength converting member 96.

As shown in FIG. 21, among the blue light emitted from the LED package 530, there is also light directed toward the side portion 853. The light directed to the side portion 853 is emitted from the lens member 85 without passing through the wavelength converting member 96.

As described above, red light, green light, and blue light are emitted from the light emitting unit 850. These three-color lights are reflected by the reflecting member 94 and the second reflecting member 95, as shown in FIG. 20A. These lights finally travel through the cover member 692 toward the inner side B of the storage chamber 2. These lights are then mixed in the storage chamber 2. As a result, the storage chamber 2 is illuminated in white by the light emitting unit 850.

The entire interior of the storage chamber 2 can be brighter by the light emitting unit 850 of the eighth embodiment. And by the light emitting unit 850, glare is reduced and a user can find the article 100 (see FIG. 6) in the storage chamber 2 more easily.

Fine irregularities may be formed on the side portion 853 to increase the degree of light diffusion of the side portion 853. The light extraction efficiency from the side portion 853 may be increased. In this case, the degree of light diffusion of the side portion 853 may be equal to the degree of light diffusion of the wavelength converting member 96.

In the illumination unit 890 according to the eighth embodiment, deterioration of optical efficiency is suppressed similarly to the illumination unit 750 of the seventh embodiment. In the illumination unit 850 of the eighth embodiment, the blue light is irradiated toward the storage chamber 2 without passing through the optical member such as the wavelength converting member 96. Therefore, loss of light energy such as fresnel loss is suppressed in the blue light which has arrived at the storage chamber 2 without passing through the wavelength converting member 96. That is, in the illumination unit 890, deterioration of the optical efficiency is suppressed. As a result, for example, the illuminance in the storage chamber 2 can be increased.

In the eighth embodiment, the wavelength converting member 96 is fixed to the lens member 75. That is, the wavelength converting member 96 is supported by itself. Accordingly, it is not necessary to provide a support member for supporting the wavelength converting member 96, and the cost for parts can be reduced.

The illumination unit 890 of the eighth embodiment is not limited to the lamp of the refrigerator 1 but may be applied to general illumination lamps. In this case, the case 91, the cover member 692, the reflecting member 94, and the second reflecting member 95 are not essential, and the light emitting unit 850 may be used as an illumination.

In the seventh embodiment and the eighth embodiment, the LED package 530 is applied, but the light source may be a single light emitting semiconductor chip. In the seventh embodiment and the eighth embodiment, the space 75C and the space 85C are formed around the LED package 530, but the space 75C and the space 85C are not essential. The lens member 75 and the lens member 85 may be provided so that a gap is not formed between the LED package 530 and the light emitting semiconductor chip. In this case, since no gap is formed, loss of light energy such as Fresnel loss is further suppressed.

Hereinafter, the light emitting unit 1050 of the fifth alternative embodiment will be described as a modification of the light emitting unit 850 of the eighth embodiment.

Figure 22:
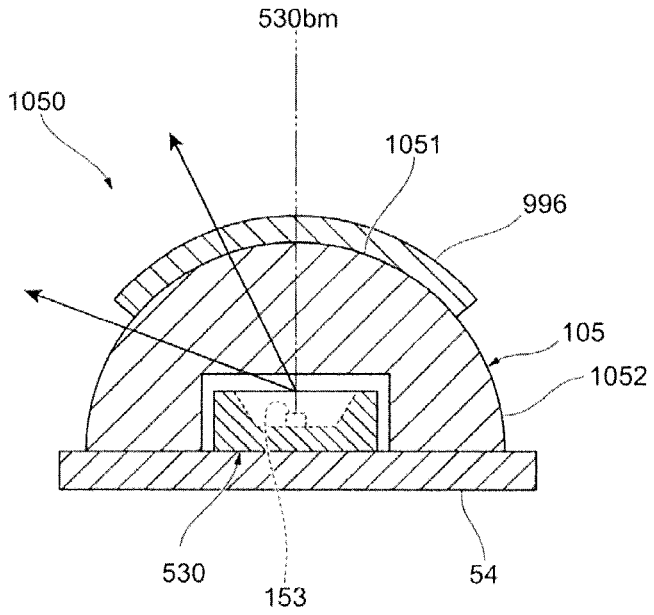
FIG. 22 is a view for explaining a light emitting unit according to a fifth alternative embodiment.

FIG. 22 is a view for explaining a light emitting unit according to a fifth alternative embodiment.

As shown in FIG. 22, the light emitting unit 1050 of the fifth alternative embodiment includes an LED package 530, a lens member 105 mounted opposite to the LED package 530, a substrate 54 and a wavelength converting member 996.

The basic configuration of the light emitting unit 1050 is similar to that of the light emitting unit 850 of the eighth embodiment. However, the configuration of the lens member 105 and the wavelength converting member 996 is different from that of the light emitting unit 850.

In the light emitting unit 1050 of the fifth alternative embodiment, the cross section of the lens member 105 is formed in a semicircular shape. The cross section of the wavelength converting member 996 is formed in an arc shape. The wavelength converting member 996 is provided at the end opposite to a side in which the LED package 530 is mounted with respect to the lens member 105.

Specifically, the lens member 105 is provided with an opposing portion 1051 opposed to the wavelength converting member 996. The wavelength converting member 996 is fixed to the opposing portion 1051 by adhesion or the like. The lens member 105 also has a proceeding portion 1052 to allow the light from the LED package 530 to proceed without passing through the wavelength converting member 996. The proceeding portion 1052 is provided so as to be adjacent to the opposing portion 1051. The proceeding portion 1052 bypasses the wavelength converting member 996 to form a path through which the light travels to the outside of the lens member 105. It is preferable that a surface area of the proceeding portion 1052 is smaller than a surface area of the opposing portion 1051.

In the light emitting unit 1050 of the fifth alternative embodiment, the wavelength converting member 996 is not provided on the entire outer periphery of the lens member 105 formed in a semicircular shape. That is, all the light from the LED package 530 is not passed through the wavelength converting member 996. A part of the light incident on the lens member 105 is directly output from the lens member 105.

The entire interior of the storage chamber 2 can be brighter by the light emitting unit 1050 of the fifth alternative embodiment. And glare is reduced and a user can find the article 100 (see FIG. 6) in the storage chamber 2 more easily.

The above description are made in relation that the illumination units of the first to eighth embodiments and the alternative embodiments are applied to the refrigerator 1, but the embodiments are not limited to the refrigerator 1. The illumination units of the first to eighth embodiments and alternative embodiments can be used as illumination for illuminating an inside of a storage chamber, for example, an illumination apparatus. It may not be necessary to suppress the light traveling toward the front side of the storage chamber. In this case, configurations for suppressing light traveling toward the front side of the storage chamber are not essential.

The invention claimed is:

1. A refrigerator comprising:

a storage chamber having an opening formed at a front thereof; and an illumination unit mounted on a surface in the storage chamber, the illumination unit including:

a light emitting member configured to emit light, and an optical member configured to guide the light emitted from the light emitting member to form a light distribution pattern directed rearward in the storage chamber with respect to the opening, wherein a direction of a light having a maximum luminance of the light emitted from the light emitting member and included in the light distribution pattern defines an optical axis of the light distribution pattern, and the optical axis is not less than 20° and not more than 60° with respect to an axis extending perpendicular to the surface of the storage chamber, to thereby guide the light emitted from the light emitting member to proceed rearward in the storage chamber with respect to the opening and to prevent light included in the light emitted from the light emitting member and which is directed from the light emitting member forward toward the opening from proceeding forward toward the opening.

2. The refrigerator according to claim 1, wherein the optical member includes at least one reflector to reflect the light from the light emitting member, to thereby guide the light emitted from the light emitting member.

3. The refrigerator according to claim 1, wherein the optical member includes a lens member positioned in front of the light emitting member and including a plurality of contiguous areas having different cross sections to refract the light emitted from the light emitting member and thereby guide the light emitted from the light emitting member.

4. The refrigerator according to claim 3, wherein the illumination unit includes a cover member through which the light emitted from the light emitting member passes.

5. A refrigerator comprising:

a storage chamber having an opening formed at a front thereof; and an illumination unit mounted on a surface in the storage chamber, the illumination unit including:

a light emitting member configured to emit light, an optical member configured to guide the light emitted from the light emitting member, and a cover member through which the light guided by the optical member passes, the cover member including a first cover portion having a degree of light diffusion, and a second cover portion having a degree of light diffusion higher than the degree of light diffusion of the first cover portion and provided in parallel with the first cover portion;

the optical member and the cover member thereby guiding the light emitted from the light emitting member rearward in the storage chamber with respect to the opening and preventing the light emitted from the light emitting member from proceeding forward toward the opening.

6. The refrigerator according to claim 5, wherein the first cover portion and the second cover portion are integrally formed with each other.

7. The refrigerator according to claim 6, wherein the first cover portion and the second cover portion are provided to be in a range of 20 degrees or more and 60 degrees or less with respect to an axis extending perpendicular to the surface.

8. The refrigerator according to claim 4, wherein the optical member further comprises a reflecting member, and light emitted from the light emitting member is reflected by the reflecting member and is incident on the cover member.

9. The refrigerator according to claim 1, wherein the optical member includes a first reflecting member positioned in front of the light emitting member and reflecting light that is directed to an inside of the storage chamber, and a second reflecting member reflecting the light reflected from the first reflecting member toward a rear of the inside of the storage chamber.

10. The refrigerator according to claim 3, wherein the illumination unit includes a plurality of the light-emitting members, and the lens member is positioned in front of the plurality of light-emitting members.

11. The refrigerator according to claim 3, wherein the illumination unit includes:

a plurality of the light-emitting members, and a plurality of the lens members provided so as to correspond, respectively, to the plurality of light emitting members.

12. The refrigerator according to claim 5, wherein the optical member includes a wavelength converting member to convert a wavelength of light emitted from the light emitting member.

13. The refrigerator according to claim 12, wherein the wavelength converting member includes a fluorescent substance that absorbs light emitted from the light emitting member and emits light of a long wavelength.

14. The refrigerator according to claim 13, wherein the wavelength converting member includes a green fluorescent portion that absorbs blue light and emits green light, and a red fluorescent portion that absorbs blue light and emits red light.

15. A refrigerator comprising:

a storage chamber; and an illumination unit mounted in the storage chamber, wherein the illumination unit includes:

a light emitting member configured to emit light, and a cover member including a plurality of first diffusion portions having a first degree of light diffusion, and a plurality of second diffusion portions having a second degree of light diffusion larger than the first degree of light diffusion, wherein the plurality of first diffusion portions and the plurality of second diffusion portions are alternatively arranged, so that the cover member thereby guides the light emitted by the light emitting member into an inside of the storage chamber.

16. The refrigerator according to claim 15, wherein the first diffusion portion is inclined at a predetermined angle with respect to an axis extending perpendicular from a surface of the storage chamber on which the illumination unit is mounted, and the second diffusion portion extends parallel to the first diffusion portion.

17. The refrigerator according to claim 15, further comprising:

a reflecting member configured to reflect light emitted from the light emitting member so as to be incident on the cover member, and an optical member configured to guide light emitted from the light emitting member so as to be incident on the reflecting member.

18. The refrigerator according to claim 17, wherein in one surface of the reflecting member, an angle formed between an optical axis of a reflecting surface distant from the light emitting member and an axis extending perpendicular from a surface of the storage chamber on which the illumination unit is mounted is smaller than an angle formed between an optical axis of a reflecting surface adjacent to the light emitting member and the axis extending perpendicular from the surface of the storage chamber on which the illumination unit is mounted.

19. The refrigerator according to claim 1, wherein the illumination unit includes a substrate that is parallel to the surface, and the light emitting member is a light emitting diode (LED) formed on the substrate, so that a major surface of the LED is parallel to the surface.

* * * * *